US011292977B2

(12) United States Patent
Brown et al.

(10) Patent No.: US 11,292,977 B2
(45) Date of Patent: Apr. 5, 2022

(54) PRODUCTION OF LUBRICANT OILS FROM THERMALLY CRACKED RESIDS

(71) Applicant: ExxonMobil Research and Engineering Company, Annandale, NJ (US)

(72) Inventors: Stephen H. Brown, Lebanon, NJ (US); Brenda A. Raich, Annandale, NJ (US); Beatrice M. Gooding, Hopewell, NJ (US); Stephen M. Davis, Dawsonville, GA (US); Federico Barrai, Houston, TX (US); Warren B. Ames, Titusville, NJ (US); Keith K. Aldous, Montgomery, TX (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 17/066,573

(22) Filed: Oct. 9, 2020

(65) Prior Publication Data

US 2021/0024846 A1 Jan. 28, 2021

Related U.S. Application Data

(62) Division of application No. 15/096,867, filed on Apr. 12, 2016, now abandoned.

(51) Int. Cl.
*C10M 101/02* (2006.01)
*C10G 55/04* (2006.01)
(Continued)

(52) U.S. Cl.
CPC ..... *C10M 101/02* (2013.01); *C10G 53/04* (2013.01); *C10G 55/04* (2013.01); *C10G 67/00* (2013.01);
(Continued)

(58) Field of Classification Search
CPC .... C12M 101/02; C10G 67/00; C10G 67/049; C10G 53/04; C10G 67/0454;
(Continued)

(56) References Cited

U.S. PATENT DOCUMENTS 3,730,877 A 5/1973 Quik et al.
3,929,616 A 12/1975 Mead et al.
(Continued)

FOREIGN PATENT DOCUMENTS

WO 01/60952 A1 8/2001

OTHER PUBLICATIONS

The International Search Report and Written Opinion of PCT/US2016/027213 dated Jul. 18, 2016.

*Primary Examiner* — Ellen M McAvoy
(74) *Attorney, Agent, or Firm* — Scott F. Yarnell

(57) ABSTRACT

Methods are provided for processing deasphalted gas oils derived from thermally cracked resid fractions to form Group I, Group II, and/or Group III lubricant base oils. The yield of lubricant base oils (optionally also referred to as base stocks) can be increased by thermally cracking a resid fraction at an intermediate level of single pass severity relative to conventional methods. By performing thermal cracking to a partial level of conversion, compounds within a resid fraction that are beneficial for increasing both the viscosity and the viscosity index of a lubricant base oil can be retained, thus allowing for an improved yield of higher viscosity lubricant base oils from a thermally cracked resid fraction.

20 Claims, 12 Drawing Sheets

(51) Int. Cl.

| | |
|---|---|
| ***C10G 69/06*** | (2006.01) |
| ***C10G 67/00*** | (2006.01) |
| ***C10G 67/04*** | (2006.01) |
| ***C10G 53/04*** | (2006.01) |
| *C10N 20/02* | (2006.01) |

(52) U.S. Cl.
CPC ..... *C10G 67/049* (2013.01); *C10G 67/0454* (2013.01); *C10G 69/06* (2013.01); *C10G 2300/1059* (2013.01); *C10G 2400/10* (2013.01); *C10N 2020/02* (2013.01)

(58) Field of Classification Search
CPC ..... C10G 55/04; C10G 69/06; C10G 2300/1059; C10G 2400/10; C10G 2300/107; C10N 2020/02
See application file for complete search history.

(56) References Cited

U.S. PATENT DOCUMENTS 4,446,004 A * 5/1984 Chen ..... C10B 55/00 208/57
4,640,762 A 2/1987 Woods et al.
6,511,937 B1 1/2003 Bearden, Jr. et al.
2004/0245147 A1 12/2004 Boucher Ashe
2007/0287643 A1* 12/2007 Matsui ..... C10M 101/02 508/363
2011/0005972 A1* 1/2011 Kim ..... C10G 65/043 208/65
2011/0011768 A1* 1/2011 Keusenkothen ..... B01J 8/0438 208/14
2011/0089080 A1* 4/2011 Kim ..... C10G 67/0481 208/66
2012/0184787 A1 7/2012 Miller
2013/0048537 A1* 2/2013 Noh ..... C10G 55/08 208/70
2013/0161236 A1 6/2013 Strauss et al.
2013/0161237 A1 6/2013 Woo et al.
2013/0240410 A1 9/2013 Gillis
2014/0042056 A1 2/2014 Daage et al.
2015/0027925 A1 1/2015 Joseck et al.
2016/0042830 A1* 2/2016 Ohno ..... H01B 3/22 252/570
2016/0298048 A1* 10/2016 Brown ..... C10G 55/04
2017/0183575 A1* 6/2017 Rubin-Pitel ..... C10G 67/049
2017/0283718 A1* 10/2017 Patrick ..... C10G 69/08
2018/0112141 A1* 4/2018 Patrick ..... C10G 67/02
2018/0371343 A1* 12/2018 Rubin-Pitel ..... C10L 1/04
2019/0194562 A1* 6/2019 Eichelsdoerfer ..... C10G 45/64

* cited by examiner

Deasphalted oil yield as a function of temperature and treat ratio for propane deasphalted HKGO.

API gravity of deasphalted oil as a function of temperature and treat ratio for propane deasphalted HKGO.

PRODUCTION OF LUBRICANT OILS FROM THERMALLY CRACKED RESIDS

CROSS-REFERENCE TO RELATED APPLICATIONS

This application is a divisional application of U.S. application Ser. No. 15/096,867 filed Apr. 12, 2016, the entirety of which is hereby incorporated herein by reference, which claims priority to U.S. Provisional Application Ser. No. 62/146,471 filed Apr. 13, 2015, which is also herein incorporated by reference in its entirety.

FIELD

Systems and methods are provided for production of lubricant oil basestocks from resid fractions, such as resid fractions separated from a feedstock exposed to thermal cracking conditions.

BACKGROUND

Lubricant base oils are one of the higher value products that can be generated from a crude oil or crude oil fraction. The ability to generate lubricant base oils of a desired quality is often constrained by the availability of a suitable feedstock. For example, most conventional processes for lubricant base oil production involve starting with a crude fraction that has not been previously processed under severe conditions, such as a virgin gas oil fraction from a crude with moderate to low levels of initial sulfur content.

Thermally cracked resids fractions are currently produced commercially during coking and visbreaking processes. 600° F.+ (316° C.) visbreaker liquids can be difficult to hydroprocess because they typically contain 100-1000 ppm metals and 2-20 wt % n-heptane insoluble asphaltenes. 600° F.+ (316° C.) coker liquids can be more readily hydroprocessed, but such coker liquids are typically not a suitable feedstock for production of heavy neutral and brightstock base oils. During a coking process, the high molecular weight molecules that comprise heavy neutral and brightstock base oils are typically cracked to form lower boiling range compounds. Furthermore, hydrocracking whole heavy coker gasoil (600° F.+ or 316° C.+ coker product) produces a low VI basestock. More generally, typical resid hydrocracking processes tend to be used as an alternative to a coking process for achieving a high percentage of conversion of 1050° F.+ (566° C.) compounds to 1050° F.− (566° C.) compounds.

U.S. Patent Application Publication 2013/0240410 describes methods for selective separation of heavy coker gas oil. The operation of a delayed coker is modified to generate a heavy coker gas oil with an increased end boiling point. The modified heavy coker gas oil can then be exposed to a solvent deasphalting procedure. The deasphalted oil can be used as part of the feed for a fuels hydrocracking process to increase distillate product yield.

SUMMARY

In an aspect, a method for producing a lubricant base oil product is provided. The method includes providing a feedstock comprising a 650° F.+ (343° C.) fraction, at least about 10 wt % of the 650° F.+ fraction comprising a portion having a boiling point of at least about 1050° F. (566° C.); exposing at least a portion of the 650° F.+ (343° C.) fraction to effective thermal cracking conditions to form a thermal cracking effluent, the thermal cracking effluent comprising at least a first thermal cracking effluent fraction having a 10% distillation point of at least about 700° F. (371° C.) and a second thermal cracking effluent fraction having a lower boiling range, the effective thermal cracking conditions being selected for single pass conversion of about 30 wt % to about 80 wt % of the portion having a boiling point of at least about 1050° F. (566° C.); and deasphalting at least a portion of the first thermal cracking effluent to form at least a deasphalted thermal cracking effluent and a deasphalting residual product; wherein at least a first portion of the deasphalted thermal cracking effluent has a viscosity index of at least about 50 and a viscosity at 100° C. of at least about 7.0 cSt.

Optionally, the method can further include exposing the at least a first portion of the deasphalted thermal cracking effluent to a dewaxing catalyst under effective catalytic dewaxing conditions and a hydrofinishing catalyst under effective hydrofinishing conditions, to form a dewaxed, hydrofinished effluent, wherein the dewaxed, hydrofinished effluent has a viscosity index that is at least about 5 greater than the viscosity index of the at least a portion of the deasphalted thermal cracking effluent.

Optionally, the at least a first portion of the deasphalted thermal cracking effluent having a viscosity index of at least about 50 and a viscosity of at least about 7.0 cSt at 100° C. can comprise a raffinate from performing a solvent extraction on at least a second portion of the deasphalted thermal cracking effluent, a raffinate yield from performing the solvent extraction on the at least a second portion of the deasphalted thermal cracking effluent optionally being at least about 25 wt %, or at least about 30 wt %, or at least about 40 wt %, or at least about 50 wt %.

Optionally, the method can further include hydrocracking at least a second portion of the deasphalted thermal cracking effluent under effective hydrocracking conditions to form a hydrocracked deasphalted thermal cracking effluent having a sulfur content of about 300 wppm or less, the at least a first portion of the deasphalted thermal cracking effluent comprising at least a portion of the hydrocracked deasphalted thermal cracking effluent, wherein exposing the deasphalted thermal cracking effluent to the dewaxing catalyst and the hydrofinishing catalyst comprises exposing the hydrocracked deasphalted thermal cracking effluent to the dewaxing catalyst and the hydrofinishing catalyst.

In another aspect, a method for producing a lubricant base oil product, is provided, including: providing a feedstock comprising a 650° F.+ (343° C.) fraction, at least about 10 wt % of the 650° F.+ fraction comprising a portion having a boiling point of at least about 1050° F. (566° C.); deasphalting a first portion of the feedstock to form at least a first deasphalted oil and a first deasphalting residual product; exposing at least a first portion of first deasphalting residual product to effective thermal cracking conditions to form a thermal cracking effluent, the thermal cracking effluent comprising at least a first thermal cracking effluent fraction having a 10% distillation point of at least about 700° F. (371° C.) and a second thermal cracking effluent fraction having a lower boiling range, the effective thermal cracking conditions being selected for single pass conversion of about 30 wt % to about 80 wt % of the portion having a boiling point of at least about 1050° F. (566° C.); deasphalting at least a portion of the first thermal cracking effluent portion to form at least a deasphalted thermal cracking effluent, the deasphalted thermal cracking effluent having a first viscosity index; exposing at least a portion of the deasphalted thermal cracking effluent to a hydrocracking catalyst under effective hydrocracking conditions to form a hydrocracked effluent; and exposing at least a portion of the hydrocracked effluent to a dewaxing catalyst under effective catalytic dewaxing conditions, and a hydrofinishing catalyst under effective hydrofinishing conditions, to form one or more lubricant products, the one or more lubricant products having a viscosity of at least about 6 cSt at 100° C. and a viscosity index of at least about 90, a yield of the one or more lubricant products being at least about 15 wt % of the 650° F.+ (343° C.) fraction of the feedstock.

In some optional aspects, deasphalting a feedstock comprising a 650° F.+ (343° C.) fraction can comprise deasphalting a feedstock comprising the 650° F.+ fraction and a recycled fraction; exposing at least a portion of the deasphalting residual product to effective thermal cracking conditions can further comprise forming a third thermal cracking effluent having a 10% distillation point of at least 800° F.; the method can further comprise recycling at least a portion of the third thermal cracking effluent as the recycled fraction; and exposing at least a portion of the deasphalted thermal cracking effluent to a hydrocracking catalyst can comprise exposing at least a portion of the deasphalted thermal cracking effluent and at least a portion of the first deasphalted oil.

In still another aspect, a method for producing a lubricant base oil product is provided, including: providing a feedstock comprising a 650° F.+ (343° C.) fraction, at least about 10 wt % of the 650° F.+ fraction comprising a portion having a boiling point of at least about 1050° F. (566° C.); exposing at least a portion of the 650° F.+ (343° C.) fraction to effective thermal cracking conditions to form a thermal cracking effluent, the thermal cracking effluent comprising at least a first thermal cracking effluent fraction having a 10% distillation point of at least about 700° F. (371° C.) and a second thermal cracking effluent fraction having a lower boiling range, the effective thermal cracking conditions being selected for conversion of about 30 wt % to about 80 wt % of the portion having a boiling point of at least about 1050° F. (566° C.); deasphalting at least a portion of the first thermal cracking effluent fraction to form at least a deasphalted thermal cracking effluent; dewaxing at least a portion of the deasphalted thermal cracking effluent under effective solvent dewaxing conditions to form at least one lubricant base oil product; and exposing at least a portion of the at least one lubricant base oil product to a hydrofinishing catalyst under effective hydrofinishing conditions, wherein the at least a portion of the deasphalted thermal cracking effluent has a first viscosity index when exposed to the hydrofinishing catalyst, the dewaxed, hydrofinished effluent having a viscosity index that is at least about 5 greater than the first viscosity index.

DETAILED DESCRIPTION

Figure 1:
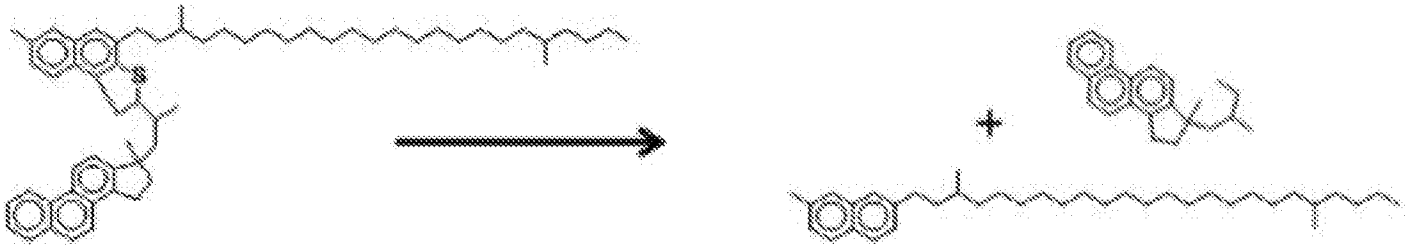
FIGS. 1 and 2 schematically show examples of potential thermal cracking reactions.

All numerical values within the detailed description and the claims herein are modified by "about" or "approximately" the indicated value, and take into account experimental error and variations that would be expected by a person having ordinary skill in the art.

Overview

In various aspects, methods are provided for processing deasphalted gas oils derived from thermally cracked resid fractions to form Group I, Group II, and/or Group III lubricant base oils. The yield of lubricant base oils (optionally also referred to as base stocks) can be increased by thermally cracking a resid fraction at an intermediate level of severity for a single pass relative to conventional methods. By performing thermal cracking to a partial level of conversion, compounds within a resid fraction that are beneficial for increasing both the viscosity and the viscosity index of a lubricant base oil can be retained, thus allowing for an improved yield of higher viscosity lubricant base oils from a thermally cracked resid fraction. Optionally, the thermally cracked resid fractions can be resid fractions that are thermally cracked in the presence of a catalyst, such as a hydrocracking catalyst.

In some aspects, the thermally cracked resid can be deasphalted and then hydrocracked as part of processing to form lubricant base oils. In such aspects, dewaxing and hydrofinishing processes can be used after and/or in conjunction with the hydrocracking process. In other aspects, the thermally cracked resid can be deasphalted, dewaxed, and hydrofinished to form lubricant base oils. In such aspects, a substantial increase in viscosity index can be achieved even though hydrocracking is not performed.

In still other aspects, methods are provided for forming naphthenic base oils from a thermally cracked resid. The thermally cracked resid can be deasphalted, and then the deasphalted oil can be saturated. The saturation of the multi-ring structures in the deasphalted oil can produce a high viscosity, high viscosity index base stock with more than 20 wt % naphthenes.

In yet other aspects, methods are provided for deasphalting a vacuum resid feed and then thermally cracking the "rock" generated from deasphalting to form additional products. Optionally the products can include a heavy thermally cracked gas oil suitable for lubricant base oil production and a still heavier cracked portion that can be further deasphalted. Optionally, the still heavier cracked portion can be deasphalted along with the vacuum resid feed. Optionally, the deasphalted oil from deasphalting can be co-processed with the heavy thermally cracked gas oil for lubricant base stock production.

Conventionally, crude oils are often described as being composed of a variety of boiling ranges. Lower boiling range compounds in a crude oil correspond to naphtha or kerosene fuels. Intermediate boiling range distillate compounds can be used as diesel fuel or as lubricant base oils. If any higher boiling range compounds are present in a crude oil, such compounds are considered as residual or "resid" compounds, corresponding to the portion of a crude oil that is left over after performing atmospheric and/or vacuum distillation on the crude oil.

In some conventional processing schemes, a resid fraction can be deasphalted, with the deasphalted oil used as part of a feed for forming lubricant base oils. These types of processing schemes are typically selected for processing of crude oils considered to have a sufficiently high yield of lubricant base oils. The remaining rock left over after deasphalting can then, for example, be processed in a coker or blended into fuel oil.

In other conventional processing schemes, the resid portion of a crude oil can be exposed to a thermal cracking process, such as coking, to reject a portion of the carbon while converting the remaining portion of the crude to lower boiling naphtha or distillate fuel fractions. In order to maximize the usage of the resid, such processes are usually performed to achieve substantially complete conversion of the 1050° F.+ (566° C.) portion of the resid. The gas oil portion of such a thermally cracked feed can be processed to form lubricant base oils, but the yield of lubricant base oils is primarily low viscosity. It is now believed that the yield of primarily low viscosity base oils is due to removal of high viscosity, high VI components during the thermal cracking.

It has been determined that various alternative process flows can allow for production of higher viscosity and high viscosity index lubricant base oils from lower value resid feeds. In these inventive alternative process flows, a resid fraction can be partially converted relative to a 1050° F. (566° C.) conversion temperature via one or more types of thermal cracking processes. By performing only a partial conversion of the resid fraction using a thermal cracking process, the conversion process can be halted at a stage where resid molecules that can contribute to both a high viscosity and a high viscosity index lubricant oil are still present in the resid fraction. Such a partial conversion can correspond to conversion conditions that result in conversion of about 30 wt % to about 80 wt % of the 1050° F.+ (566° C.) portion of a resid fraction during a single pass. The partially thermally cracked resid can then be deasphalted, with the resulting deasphalted oil being suitable for further processing to form lubricant base oils.

One advantage of using a coking or other thermal cracking method with a moderate amount (such as 30 wt % to 80 wt %) of single pass conversion relative to 1050° F. (566° C.) can be that multi-ring aromatic compounds with long linear alkyl sidechains can be preserved in the 700° F.+ (370° C.+) coker liquid product. High viscosity, high viscosity index coker liquid products boiling above 1000° F. (538° C.) ("unconverted" coker product) are especially valuable. These "unconverted" and partially converted compounds (kinetic products of thermal cracking) can then be saturated, such as by using an aromatic saturation or a hydrofinishing process. Saturating these unconverted multi-ring compounds can provide a substantial boost to the viscosity index of the resulting hydrofinished product. For example, hydrofinishing and/or other aromatic saturation can allow for an increase in viscosity index of at least about 5, or at least about 10, or at least about 15, or at least about 20, and up to about 40. An example of increasing viscosity index by at least about 10 can be increasing a viscosity index from about 75 to about 85. Conventionally, achieving such a viscosity index increase is believed to require a more severe type of process, such as a hydrotreating or hydrocracking process. In various aspects, such a viscosity index increase can be achieved based on a combination of performing a moderate amount of conversion during thermal cracking followed by aromatic saturation.

Figure 2:
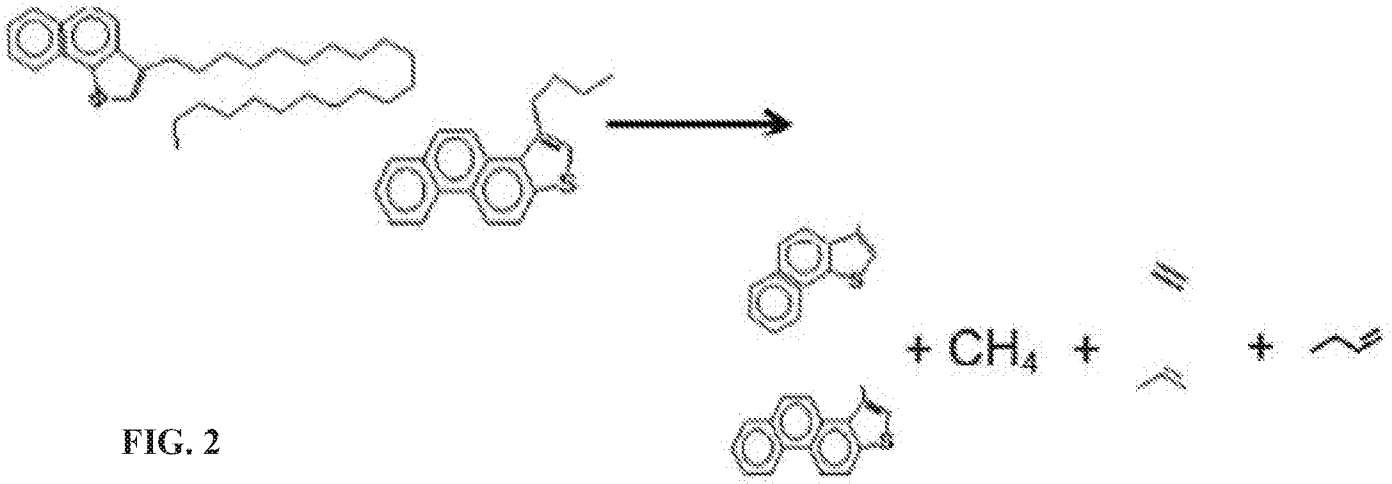

FIGS. 1 and 2 schematically show an example of the potential benefit of performing an intermediate amount of thermal cracking on a feedstock containing a 1050° F.+ (566° C.) resid portion. Without being bound by any particular theory, during the initial stages of thermal cracking, it is believed that thermal cracking on a heavy oil or resid type feed can result in conversion of heavier compounds to polynuclear aromatic cores and 2-4 ring naphthenic and aromatic hydrocarbons with long linear sidechains. An example of a potential conversion process during removal of a sulfur atom is shown in FIG. 1. In FIG. 1, it is noted that dealkylation is believed to be a less important process during the initial stages of performing thermal cracking. For the examples of reaction products shown in FIG. 1, it is noted that the 2-4 ring naphthenic and aromatic hydrocarbons with long linear sidechains products have the potential to be valuable for forming a high viscosity and high viscosity index lubricant base oil. If a thermal cracking process can be controlled to preserve this type of product, the amount of high viscosity, high viscosity index lubricant base oil generated from a resid fraction can be increased.

For thermal cracking processes that are allowed to proceed to near complete conversion of the 1050° F.+ (566° C.) fraction of a feed, the initial kinetic products of thermal cracking spend more time at coking temperatures and undergo secondary reactions—such as aromatic dealkylation—to molecules boiling below 650° F. (343° C.) that are not useful as lubricants. This can result in a situation similar to the example shown in FIG. 2, where a compound is exposed to thermal cracking conditions for a longer period of time, resulting in dealkylation and/or additional cracking of any products potentially useful as lubricants. As a result, in later stages of thermal conversion, the product mix can be changed toward primarily polynuclear aromatic cores and light ends. Such products are less suitable for forming high viscosity and high viscosity index lubricant base oils.

Group I basestocks or base oils are defined as base oils with less than 90 wt % saturated molecules and/or at least 0.03 wt % sulfur content. Group I basestocks also have a viscosity index (VI) of at least 80 but less than 120. Group II basestocks or base oils contain at least 90 wt % saturated molecules and less than 0.03 wt % sulfur. Group II basestocks also have a viscosity index of at least 80 but less than 120. Group III basestocks or base oils contain at least 90 wt % saturated molecules and less than 0.03 wt % sulfur, with a viscosity index of at least 120. In addition to the above formal definitions, some Group I basestocks may be referred to as a Group I+ basestock, which corresponds to a Group I basestock with a VI value of 103 to 108. Some Group II basestocks may be referred to as a Group II+ basestock, which corresponds to a Group II basestock with a VI of at least 113. Some Group III basestocks may be referred to as a Group III+ basestock, which corresponds to a Group III basestock with a VI value of at least 140.

In the discussion below, a stage can correspond to a single reactor or a plurality of reactors. Optionally, multiple parallel reactors can be used to perform one or more of the processes, or multiple parallel reactors can be used for all processes in a stage. Each stage and/or reactor can include one or more catalyst beds containing hydroprocessing catalyst. Note that a "bed" of catalyst in the discussion below can refer to a partial physical catalyst bed. For example, a catalyst bed within a reactor could be filled partially with a hydrocracking catalyst and partially with a dewaxing catalyst. For convenience in description, even though the two catalysts may be stacked together in a single catalyst bed, the hydrocracking catalyst and dewaxing catalyst can each be referred to conceptually as separate catalyst beds.

In this discussion, unless otherwise specified the lubricant product fraction of a hydroprocessed feedstock corresponds to the fraction having an initial boiling point or alternatively a T5 boiling point of at least about 370° C. (700° F.). A distillate fuel product fraction, such as a diesel product fraction, corresponds to a product fraction having a boiling range from about 193° C. (375° F.) to about 370° C. (700° F.). Thus, distillate fuel product fractions have initial boiling points (or alternatively T5 boiling points) of at least about 193° C. and final boiling points (or alternatively T95 boiling points) of about 370° C. or less. A naphtha fuel product fraction corresponds to a product fraction having a boiling range from about 50° C. (122° F.) to about 193° C. (375° F.) to about 370° C. (700° F.). Thus, naphtha fuel product fractions have initial boiling points (or alternatively T5 boiling points) of at least about 50° C. and final boiling points (or alternatively T95 boiling points) of about 193° C. or less. It is noted that 50° C. roughly corresponds to a boiling point for the various isomers of a C6 alkane. Light ends are defined as products with boiling points below about 50° C., which include various C1-C5 compounds. When determining a boiling point or a boiling range for a feed or product fraction, an appropriate ASTM test method can be used, such as the procedures described in ASTM D2887 or D86.

Feedstocks

In various aspects, a (hydroprocessed) lubricant base oil product is produced from a whole or reduced crude, or from a feedstock corresponding to a heavy oil feed component. Examples of heavy oils include, but are not limited to, heavy crude oils, distillation residues, oils (such as bitumen) from oil sands and heavy oils derived from coal.

Heavy oil feedstocks can be liquid or semi-solid. Examples of heavy oils that can be hydroprocessed, treated or upgraded according to this disclosure include bitumens and residuum from refinery distillation processes, including atmospheric and vacuum distillation processes. Such heavy oils can have an initial boiling point (such as an initial ASTM D2892 boiling point) of 650° F. (343° C.) or greater. Preferably, the heavy oils will have an 10% distillation point (such as an ASTM D2892 10% distillation point) of at least 650° F. (343° C.), alternatively at least 660° F. (349° C.) or at least 750° F. (399° C.). In some aspects the 10% distillation point can be still greater, such as at least 900° F. (482° C.), or at least 950° F. (510° C.), or at least 975° F. (524° C.), or at least 1020° F. (549° C.) or at least 1050° F. (566° C.).

In addition to initial boiling points and/or 10% distillation points, other distillation points may also be useful in characterizing a feedstock. For example, a feedstock can be characterized based on the portion of the feedstock that boils above 1050° F. (566° C.). In some aspects, a feedstock can have an (ASTM D2892) 70% distillation point of 1050° F. or greater, or a 60% distillation point of 1050° F. or greater, or a 50% distillation point of 1050° F. or greater, or a 40% distillation point of 1050° F. or greater.

It is noted that one method for providing a heavy oil feed to a thermal cracking process can be to provide an initial feedstock with a broader boiling range, such as a whole crude or another full boiling range crude, and distill the heavy oil portion of the initial feedstock to provide the heavy oil feed. For example, an initial feedstock with a broader boiling range can be distilled or otherwise fractionated to provide a heavy oil feed with a 10% distillation point (or optionally an initial boiling point) of at least about 650° F. (343° C.), such as at least about 700° F. (371° C.). Alternatively, a broader boiling range feedstock can be passed into the thermal cracking process if desired. For example, an initial feedstock with a lower initial boiling point, such as an initial boiling point of about 350° F. (177° C.), or about 400° F. (204° C.), can be passed into the thermal cracking process. This can simplify any initial distillation or fractionation. A fractionation or distillation will also be performed after the thermal cracking process, so other than acting as a diluent, the presence of lower boiling compounds in the thermal cracking process does not substantially alter the nature of the thermal cracking.

Another feature of the heavy oil fraction can be the portion of the heavy oil fraction that is in the boiling range of 1050° F.+ (566° C.). In various aspects, one of the goals of the thermal cracking process is to provide a limited amount of thermal cracking on the 1050° F.+ (566° C.) portion of the feedstock, so that about 30 wt/to about 80 wt % of the 1050° F.+ (566° C.) portion of the heavy oil is converted in a single pass to compounds with a boiling point below 1050° F. (566° C.). Suitable feedstocks for processing according to the processes described herein can thus be characterized based on the boiling profile of the 650° F.+ (316° C.) portion of a feedstock. Within the 650° F.+ (316° C.) portion of a feedstock, the wt % of the 1050° F.+ (566° C.) portion of the feedstock can be at least about 10 wt %, or at least about 15 wt %, or at least about 20 wt %, or at least about 25 wt %, or at least about 30 wt %.

Density, or weight per volume, of the heavy hydrocarbon can be determined according to ASTM D287-92 (2006) Standard Test Method for API Gravity of Crude Petroleum and Petroleum Products (Hydrometer Method), and is provided in terms of API gravity. In general, the higher the API gravity, the less dense the oil. API gravity is 200 or less in one aspect, 15° or less in another aspect, and 10° or less in another aspect.

Heavy oil feedstocks (also referred to as heavy oils) can be high in metals. For example, the heavy oil can be high in total nickel, vanadium and iron contents. In one embodiment, the heavy oil will contain at least 0.00005 grams of Ni/V/Fe (50 ppm) or at least 0.0002 grams of Ni/V/Fe (200 ppm) per gram of heavy oil, on a total elemental basis of nickel, vanadium and iron. In other aspects, the heavy oil can contain at least about 500 wppm of nickel, vanadium, and iron, such as at least about 1000 wppm.

Contaminants such as nitrogen and sulfur are typically found in heavy oils, often in organically-bound form. Nitrogen content can range from about 50 wppm to about 10,000 wppm elemental nitrogen or more, based on total weight of the heavy hydrocarbon component. The nitrogen containing compounds can be present as basic or non-basic nitrogen species. Examples of basic nitrogen species include quinolines and substituted quinolines. Examples of non-basic nitrogen species include carbazoles and substituted carbazoles.

The disclosure can be used to treat heavy oil feedstocks containing at least 500 wppm elemental sulfur, based on total weight of the heavy oil. Generally, the sulfur content of such heavy oils can range from about 500 wppm to about 100,000 wppm elemental sulfur, or from about 1000 wppm to about 50,000 wppm, or from about 1000 wppm to about 30,000 wppm, based on total weight of the heavy component. Sulfur will usually be present as organically bound sulfur. Examples of such sulfur compounds include the class of heterocyclic sulfur compounds such as thiophenes, tetrahydrothiophenes, benzothiophenes and their higher homologs and analogs. Other organically bound sulfur compounds include aliphatic, naphthenic, and aromatic mercaptans, sulfides, and di- and polysulfides.

Heavy oils can be high in n-pentane asphaltenes. In some aspects, the heavy oil can contain at least about 5 wt % of n-pentane asphaltenes, such as at least about 10 wt % or at least 15 wt % n-pentane asphaltenes.

Still another method for characterizing a heavy oil feedstock is based on the Conradson carbon residue of the feedstock. The Conradson carbon residue of the feedstock can be at least about 5 wt %, such as at least about 10 wt % or at least about 20 wt %. Additionally or alternately, the Conradson carbon residue of the feedstock can be about 50 wt % or less, such as about 40 wt % or less or about 30 wt % or less.

One way of defining a feedstock is based on the boiling range of the feed. One option for defining a boiling range is to use an initial boiling point for a feed and/or a final boiling point for a feed. Another option, which in some instances may provide a more representative description of a feed, is to characterize a feed based on the amount of the feed that boils at one or more temperatures. For example, a "T5" boiling point for a feed is defined as the temperature at which 5 wt % of the feed will boil off. Similarly, a "T95" boiling point is a temperature at 95 wt % of the feed will boil.

In various aspects of the disclosure, reference may be made to one or more types of fractions generated during distillation of a petroleum feedstock. Such fractions may include naphtha fractions, kerosene fractions, diesel fractions, and (vacuum) gas oil fractions. Each of these types of fractions can be defined based on a boiling range, such as a boiling range that includes at least 90 wt % of the fraction, and preferably at least 95 wt % of the fraction. For example, for many types of naphtha fractions, at least 90 wt % of the fraction, and preferably at least 95 wt %, can have a boiling point in the range of 85° F. (29° C.) to 350° F. (177° C.). For some heavier naphtha fractions, at least 90 wt % of the fraction, and preferably at least 95 wt %, can have a boiling point in the range of 85° F. (29° C.) to 400° F. (204° C.). For a kerosene fraction, at least 90 wt % of the fraction, and preferably at least 95 wt %, can have a boiling point in the range of 300° F. (149° C.) to 600° F. (288° C.). Alternatively, for a kerosene fraction targeted for some uses, such as jet fuel production, at least 90 wt % of the fraction, and preferably at least 95 wt %, can have a boiling point in the range of 300° F. (149° C.) to 550° F. (288° C.). For a diesel fraction, at least 90 wt % of the fraction, and preferably at least 95 wt %, can have a boiling point in the range of 400° F. (204° C.) to 750° F. (399° C.).

Typical gas oil fractions can include, for example, fractions with an initial boiling point of at least about 650° F. (343° C.), or at least about 700° F. (371° C.), or at least about 750° F. (399° C.). Alternatively, a gas oil fraction may be characterized using a T5 boiling point, such as a fraction with a T5 boiling point of at least about 650° F. (343° C.), or at least about 700° F. (371° C.), or at least about 750° F. (399° C.). In some aspects, the final boiling point of a gas oil fraction can be about 1150° F. (621° C.) or less, such as about 1100° F. (593° C.) or less, or about 1050° F. (566° C.) or less. Alternatively, a gas oil fraction may be characterized using a T95 boiling point, such as a fraction with a T95 boiling point of about 1150° F. (621° C.) or less, or about 1100° F. (593° C.) or less, or about 1050° F. (566° C.) or less. In still other aspects, a gas oil fraction can correspond to a lower boiling gas oil fraction, with a T95 boiling point or final boiling point of about 1000° F. (538° C.) or less, such as about 935° F. (500° C.) or less. An example of a suitable type of gas oil fraction is a wide cut vacuum gas oil (VGO), with a T5 boiling point of at least about 700° F. (371° C.) and a T95 boiling point of about 1100° F. or less, preferably a T95 boiling point of about 1000° F. (538° C.) or less.

Thermal Cracking Methods—Coking and Hydroconversion

In various aspects, the amount of high viscosity and high viscosity index lubricant base oils generated from a feed that includes a resid fraction can be enhanced by exposing the feed to thermal cracking conditions suitable for conversion of about 30 wt % to about 80 wt % of the 1050° F.+ (566° C.) portion of the feed. The thermal cracking can be performed by any convenient method that allows for suitable amounts of conversion, such as by fluidized coking, optionally but preferably operated in a once-through configuration, optionally but more preferably operated in a deep recycle cutpoint configuration, or by hydroconversion. In fluidized bed coking, normal operation uses a 975° F. (524° C.) recycle cutpoint and produces a heavy coker gasoil with 5-10 wt % of an unconverted 1050° F.+ (566° C.) portion. Deep recycle cutpoint operation increases the recycle cutpoint to 1000° F. (538° C.) or greater, and produces a heavy coker gasoil with 10-15 wt % of a 1050° F.+ (566° C.) portion. By performing a limited amount of single pass conversion of the 1050° F.+ (566° C.) portion of the feed, an increased number of compounds can be formed and/or retained within the thermally cracked feed that can contribute to lubricant base oils that have high viscosity as well as high viscosity index.

In various embodiments of the disclosure, the combination of processing conditions can be selected to achieve a desired level of conversion of a feedstock. For various types of heavy oil feedstocks, conversion relative to a fixed boiling point cutpoint temperature of 1050° F. (566° C.) is a convenient way to characterize the amount of feedstock conversion. For example, the process conditions can be selected to achieve at least about 25% conversion of the 1050° F.+ (566° C.) portion of a feedstock. In other words, the conditions are selected so that at least about 25 wt % of the portion of the feed that boils above 1050° F. (566° C.) is converted to a portion that boils below 1050° F. (566° C.). In some aspects, the amount of single pass conversion relative to 1050° F. (566° C.) can be at least about 30%, such as at least about 40% or at least about 50%. Additionally or alternately the conversion percentage can be about 80% or less, such as about 70% or less or about 60% or less. An example of a suitable amount of conversion can be a conversion percentage from about 30% to about 80%, such as about 40% to about 70%.

In various embodiments, coking is an example of a thermal cracking process that can be used to process a resid type feed as part of a process for forming lubricant base oils. An example of a suitable configuration for coking is fluidized coking. Instead of operating the coking process in a conventional manner (delayed coking) to achieve nearly complete conversion of the 1050° F.+ (566° C.) portion of a resid, the coking process can be operated to achieve about 30 wt % to about 80 wt % conversion of the 1050° F.+ (566° C.) portion of the feed. It is noted that other types of coking could be used for thermal cracking if the coking method is suitable for operation at reduced levels of conversion of the 1050° F.+ (566° C.) portion of the feed, such as delayed coking operated at some combination of lower pressure and higher temperature, or a visbreaking process. Delayed coking can be effectively operated at lower pressure by recycling 1050° F.– product fractions to the coke drum to strip out some of the 1050° F.+ (566° C.) fraction. However, such modification of the conversion percentage for the 1050° F.+ (566° C.) portion of a feed may prove difficult for some types of coking configurations, such as typical configurations for delayed coking.

Fluidized coking is a refinery process in which a heavy petroleum feedstock, typically a non-distillable residue (resid) from atmospheric and/or vacuum fractionation, is converted to lighter, more valuable materials by thermal decomposition (coking) at temperatures from about 900° F. (482° C.) to about 1100° F. (593° C.). Conventional fluid coking is performed in a process unit comprised of a coking reactor and a heater or burner. A petroleum feedstock is injected into the reactor in a coking zone comprised of a fluidized bed of hot, fine, coke particles and is distributed relatively uniformly over the surfaces of the coke particles where it is cracked to vapors and coke. The vapors pass through a gas/solids separation apparatus, such as a scrubber, where contact with 1050° F.+ liquid feedstock and/or heavy product recycle removes most of the entrained coke particles and cools the vapors to condense the heavy liquid products. In a conventional fluidized coking apparatus, the resulting slurry of vac resid feed, condensed heavy liquid product, and coke particles, which usually contains from about 1 to about 3 wt. % coke particles, is recycled to extinction to the coking zone. However, in various aspects of the disclosure, only a portion of the slurry is recycled and/or the slurry may not be recycled (once-through operation). The balance of the vapors go to a fractionator for separation of the gases and the liquids into different boiling fractions.

Some of the coke particles in the coking zone flow downwardly to a stripping zone at the base of the reactor vessel where steam removes interstitial product vapors from, or between, the coke particles. The coke particles then flow down a stand-pipe and into a riser that moves them to a burning, or heating zone, where sufficient air is injected to burn at least a portion of the coke and heating the remainder sufficiently to satisfy the heat requirements of the coking zone where the unburned hot coke is recycled. Net coke, above that consumed in the burner, is withdrawn as product coke.

Another type of fluid coking employs three vessels: a coking reactor, a heater, and a gasifier. Coke particles having carbonaceous material deposited thereon in the coking zone are passed to the heater where a portion of the volatile matter is removed. The coke is then passed to the gasifier where it reacts, at elevated temperatures, with air and steam to form a mixture of carbon monoxide, carbon dioxide, methane, hydrogen, nitrogen, water vapor, and hydrogen sulfide. The gas produced in the gasifier is passed to the heater to provide part of the reactor heat requirement. The remainder of the heat is supplied by circulating coke between the gasifier and the heater. Conventionally, coke would also typically be recycled from the heater to the coking reactor to supply the heat requirements of the reactor. However, for the desired conversion rates of about 30 wt % to about 80 wt % of the 1050° F.+ portion of the feed, the coker may be operated with a reduced amount of recycle or with no recycle (once-through operation).

Conventionally, the rate of introduction of resid feedstock to a fluid coker is limited by the rate at which it can be converted to coke. The major reactions that produce coke involve oligomerization of aromatic cores, cracking of aliphatic side chains from aromatic cores, demethylation of aromatic cores and dehydrogenation of naphthenes (aromatization). A liquid feed droplet wets dry coke particles and covers them with a low viscosity liquid film similar in composition to the liquid droplets. The reaction and vaporization of feed into product molecules changes the composition of the liquid film. The composition becomes increasingly aromatic with an increasingly higher average boiling point. This layer is relatively sticky at reaction temperature. The rate of conversion of the aromatic cores to coke is relatively slow and limits the operation of the fluid coker. For a conventional fluidized coker, at the point of fluid bed bogging (defluidizing), the rate of sticky layer disappearance to coke is similar to (instead of faster than) the rate of sticky layer formation from coke precursors in the resid feed.

In various aspects, the conversion of resid to lube precursors in a coker can be improved by performing only a partial conversion of the resid feedstock. As noted above and illustrated in FIG. 1, the cracking of complex, high boiling feed molecules into polynuclear aromatic cores and 2-4-ring napthenes and aromatics with long sidechains occurs relatively quickly in comparison with dealkylation of aromatic cores to products boiling at <700° F. (<370° C.) and oligomerization of aromatic cores to coke. Without being bound by any particular theory, cracking of complex, high boiling feed molecules into polynuclear aromatic cores and 2-4-ring napthenes and aromatics with long sidechains can correspond to a substantial portion of the desired amount of conversion when single pass conversion is limited to about 30 wt % to about 80 wt %. The slower conversion of aromatic cores to coke can be at least partially avoided by removing them instead of recycling them to the reactor. Removal can be accomplished, for example, by distillation, such as by increasing the recycle cutpoint from 975° F. (525° C.) to at least about 1000° F. (538° C.), or at least about 1050° F. (566° C.), or at least about 1100° F. (593° C.).

Figure 13:
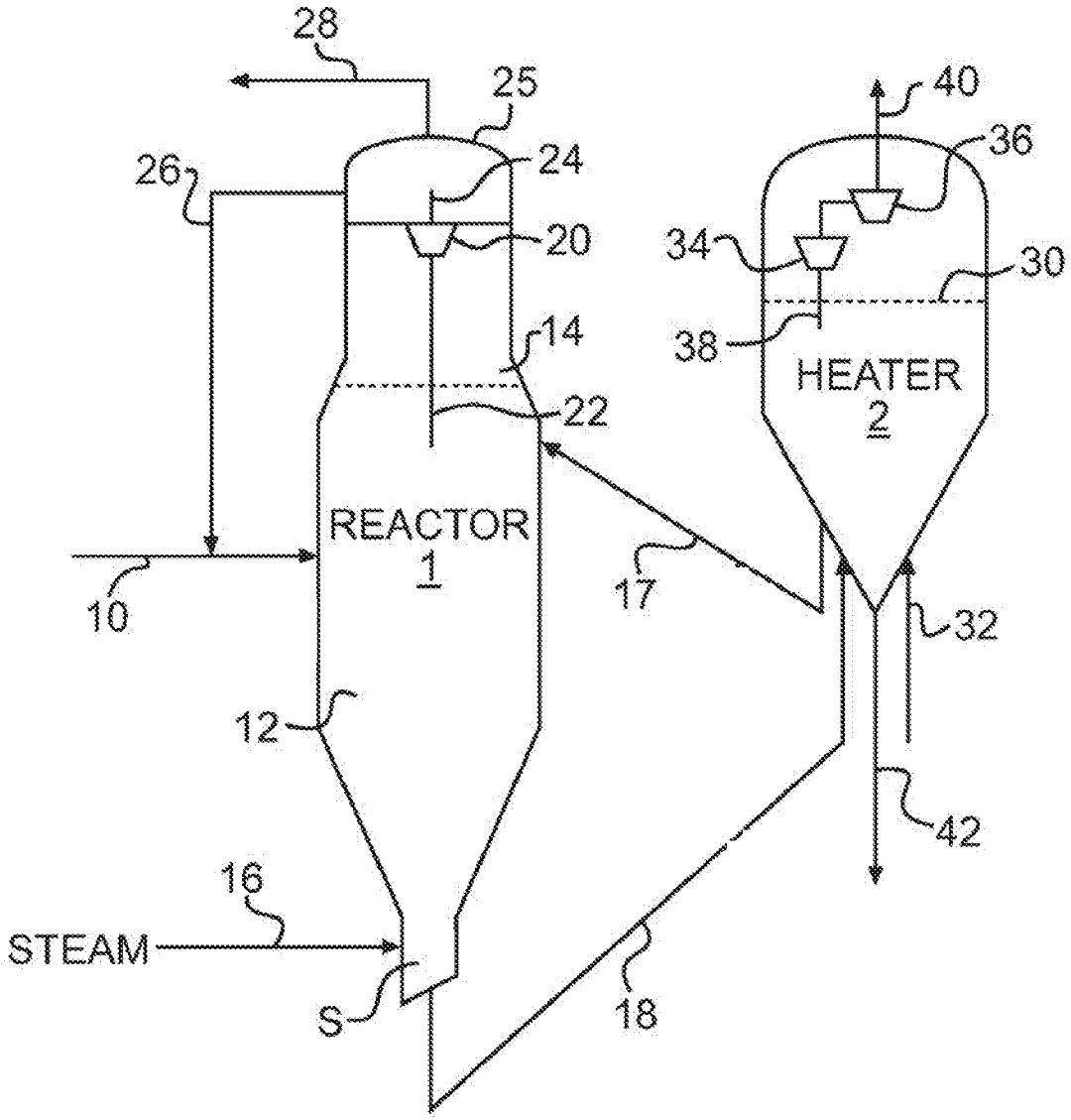
FIG. 13 shows an example of a configuration for performing thermal cracking using a coker.

Reference is now made to FIG. 13 hereof which shows a simplified flow diagram of a typical fluidized coking process unit comprised of a coking reactor and a heater. A heavy hydrocarbonaceous chargestock is conducted via line 10 into coking zone 12 that contains a fluidized bed of solids having an upper level indicated at 14. Although it is preferred that the solids, or seed material, be coke particles, they may also be any other refractory materials such as those selected from the group consisting of silica, alumina, zirconia, magnesia, alundum or mullite, synthetically prepared or naturally occurring material such as pumice, clay, kieselguhr, diatomaceous earth, bauxite, and the like. The solids will have an average particle size of about 40 to 1000 microns, preferably from about 40 to 400 microns. For purposes of this FIG. 13, the solid particles will be referred to coke, or coke particles.

A fluidizing gas e.g., steam, is introduced at the base of coker reactor 1, through line 16, in an amount sufficient to obtain superficial fluidizing velocity in the range of about 0.5 to 5 feet/second (0.15 to 1.5 m/s). Coke at a temperature above the coking temperature, for example, at a temperature from about 100° F. (38° C.) to about 400° F. (205° C.), preferably from about 150° F. (66° C.) to about 350° F. (177° C.), and more preferably from about 150° F. (66° C.) to 250° F. (121° C.), in excess of the actual operating temperature of the coking zone is admitted to reactor 1 by line 17 from heater 2 in an amount sufficient to maintain the coking temperature in the range of about 850° F. (454° C.) to about 1200° F. (650° C.). The pressure in the coking zone is maintained in the range of about 0 to 150 psig (1000 kPa), preferably in the range of about 5 (35 kPa) to 45 psig (310 kPa). The lower portion of the coking reactor serves as a stripping zone S in which occluded hydrocarbons are removed from the coke by use of a stripping agent, such as steam, as the coke particles move through the stripping zone. A stream of stripped coke is withdrawn from the stripping zone via line 18 and conducted to heater 2. Conversion products of the coking zone are passed through cyclone(s) 20 where entrained solids are removed and returned to coking zone 12 via dipleg 22. The resulting vapors exit cyclone 20 via line 24, and pass into a scrubber 25 mounted at the top of the coking reactor 1. The vapors passed into scrubber 25 are cooled and the heaviest components can be condensed. If desired, a stream of heavy materials condensed in the scrubber may be recycled to the coking reactor via line 26. Coker conversion products are removed from scrubber 25 via line 28 for fractionation in a conventional manner. In heater 2, stripped coke from coking reactor 1 (cold coke) is introduced via line 18 into a fluidized bed of hot coke having an upper level indicated at 30. The bed is heated by passing a fuel gas and/or air into the heater via line 32. The gaseous effluent of the heater, including entrained solids, passes through one or more cyclones which may include first cyclone(s) 34 and second cyclone(s) 36 wherein the separation of the larger entrained solids occur. The separated larger solids are returned to the heater via cyclone diplegs 38. The heated gaseous effluent that contains entrained solids is removed from heater 2 via line 40. Excess coke can be removed from heater 2 via line 42. A portion of hot coke is removed from the fluidized bed in heater 2 and recycled to coking reactor 1 via line 17 to supply heat to the coking zone. Although a gasifier can also be present as part of a coking reaction system, a gasifier is not shown in FIG. 13.

The differences in the amount of 950° F.+ (510° C.) material in a heavy coker gas oil from partial conversion (such as fluidized coking) versus substantially complete conversion (such as delayed coking) can result in distinctive behavior when the gas oils are processed using propane deasphalting. Performing propane deasphalting on the fluidized coker heavy coker gas oil can result in formation of a deasphalted oil and rock under a wide variety of temperature and solvent:oil conditions. Examples of suitable conditions for propane deasphalting include temperatures of about 58° C. to about 88° C. and solvent:oil ratios of about 4:1 to about 8:1. By contrast, due to the low percentage of 950° F.+ (510° C.) compounds in the delayed coker heavy coker gas oil, propane deasphalting does not result in formation of a separated deasphalted oil phase and rock phase. Instead, the heavier compounds that would be expected to form the separate rock phase remain soluble, so that substantially no separation occurs.

Hydroconversion processes (a form of hydroprocessing) can also be used to perform thermal cracking on a resid feed for production of lubricant base oils. Although hydroconversion processes are performed in the presence of hydrogen, the relative amount of hydroconversion versus the amount of thermal cracking can be controlled based on the hydroconversion conditions. In various aspects, the hydroconversion conditions can be selected to have relatively low partial pressures of hydrogen, such as about 400 psig (2.7 MPa) to about 1500 psig (10.3 MPa) of hydrogen, for example about 1250 psig (8.6 MPa) or less, or about 1000 psig (6.9 MPa) or less. The relatively low partial pressure of hydrogen can be used with temperatures of at least about 400° C., for example at least about 425° C., to provide hydroconversion conditions where a substantial portion of the reactions correspond to thermal cracking reactions.

Contacting conditions in the contacting or hydroprocessing zone can include, but are not limited to, temperature, pressure, hydrogen flow, hydrocarbon feed flow, or combinations thereof. Contacting conditions in some embodiments are controlled to yield a product with specific properties.

In various aspects, hydroconversion processes can be carried out in the presence of hydrogen and in the presence of a suitable catalyst. A hydrogen stream can be fed or injected into a vessel or reaction zone or hydroprocessing zone in which the hydroprocessing catalyst is located. Hydrogen, which is contained in a hydrogen "treat gas," is provided to the reaction zone. Treat gas, as referred to herein, can be either pure hydrogen or a hydrogen-containing gas, which is a gas stream containing hydrogen in an amount that is sufficient for the intended reaction(s), optionally including one or more other gasses (e.g., nitrogen and light hydrocarbons such as methane), and which will not adversely interfere with or affect either the reactions or the products. Impurities, such as $H_2S$ and $NH_3$ are undesirable and would typically be removed from the treat gas before it is conducted to the reactor. The treat gas stream introduced into a reaction stage will preferably contain at least about 50 vol. % and more preferably at least about 75 vol. % hydrogen.

Hydrogen can be supplied at a rate of from 300 SCF/B (standard cubic feet of hydrogen per barrel of feed) (53 S $m^3/m^3$) to 10000 SCF/B (1780 S $m^3/m^3$). Preferably, the hydrogen is provided in a range of from 1000 SCF/B (178 S $m^3/m^3$) to 5000 SCF/B (891 S $m^3/m^3$).

Hydrogen can be supplied co-currently with the resid feed or separately via a separate gas conduit to the hydroprocessing zone. The contact of the feedstock with the hydroprocessing catalyst and the hydrogen produces a total product that includes a hydroprocessed oil product, and, in some embodiments, gas.

The temperature in the contacting zone can be at least about 732° F. (390° C.) or at least about 788° F. (420° C.). Additionally or alternately, the temperature in the contacting zone can be about 950° F. (510° C.) or less, such as about 900° F. (482° C.) or less, and preferably about 850° F. (454° C.) or less or about 800° F. (427° C.) or less.

Total pressure in the contacting (hydroprocessing) zone can range from 200 psig (1379 kPa-g) to 3000 psig (20684 kPa-g), such as from 400 psig (2758 kPa-g) to 2000 psig (13790 kPa-g), or from 650 psig (4482 kPa-g) to 1500 psig (10342 kPa-g), or from 650 psig (4482 kPa-g) to 1200 psig (8273 kPa-g). Preferably, a heavy oil can be hydroprocessed under low hydrogen partial pressure conditions. In such aspects, the hydrogen partial pressure during hydroprocessing can be from about 200 psig (1379 kPa-g) to about 1000 psig (6895 kPa-g), such as from 500 psig (3447 kPa-g) to about 800 psig (5516 kPa-g). Additionally or alternately, the hydrogen partial pressure can be at least about 200 psig (1379 kPa-g), or at least about 400 psig (2758 kPa-g), or at least about 600 psig (4137 kPa-g). Additionally or alternately, the hydrogen partial pressure can be about 1000 psig (6895 kPa-g) or less, such as about 900 psig (6205 kPa-g) or less, or about 850 psig (5861 kPa-g) or less, or about 800 psig (5516 kPa-g) or less, or about 750 psig (5171 kPa-g) or less. In such aspects with low hydrogen partial pressure, the total pressure in the reactor can be about 1200 psig (8274 kPa-g) or less, and preferably 1000 psig (6895 kPa-g) or less, such as about 900 psig (6205 kPa-g) or less or about 800 psig (5516 kPa-g) or less.

Liquid hourly space velocity (LHSV) of the combined heavy hydrocarbon oil and recycle components will generally range from 0.01 to 3.0 $h^{-1}$, or 0.04 $h^{-1}$ to 2.0 $h^{-1}$, or 0.05 to 1.0 $h^{-1}$. In some aspects, LHSV is at least 1.5 $h^{-1}$, or at least 1.0 $h^{-1}$, or at least 0.5 $h^{-1}$. Alternatively, in some aspects LHSV is about 0.20 $h^{-1}$ or less, or about 0.15 $h^{-1}$ or less, or about 0.10 $h^{-1}$ or less.

Based on the reaction conditions described above, in various aspects of the disclosure, a substantial portion of the reactions taking place in the hydroprocessing reaction environment can correspond to thermal cracking reactions. In addition to the reactions expected during hydroprocessing of a feed in the presence of hydrogen and a hydroprocessing catalyst, thermal cracking reactions can also occur at temperatures of 360° C. and greater. In the hydroprocessing reaction environment, the presence of hydrogen and catalyst can reduce the likelihood of coke formation based on radicals formed during thermal cracking.

In an embodiment of the disclosure, contacting the input feed to the hydroconversion reactor with the hydroprocessing catalyst in the presence of hydrogen to produce a hydroprocessed product is carried out in a single contacting zone. In another aspect, contacting is carried out in two or more contacting zones.

Processing of Thermally Cracked Resid—Deasphalting and Aromatics Extraction

After exposing a feed containing a 1050° F.+ (566° C.) portion to thermal cracking conditions, the resulting products can be exposed to a series of additional processing steps to form products, including lubricant base oil products. As an initial procedure, the products from the thermal cracking process can be fractionated or otherwise separated to separate lower boiling portions (such as naphtha and diesel boiling range compounds) from one or more portions having a boiling range suitable for forming lubricant base oils. For example, a fractionation or other separation can be used to separate from the thermal cracking effluent one or more portions having a 10% distillation point of at least about 650° F. (343° C.), or at least about 700° F. (371° C.), or at least about 750° F. (399° C.), or at least about 800° F. (427° C.). Additionally or alternately, the thermal cracking effluent can be separated to form one or more portions having an initial boiling point of at least about 650° F. (343° C.), or at least about 700° F. (371° C.), or at least about 750° F. (399° C.), or at least about 800° F. (427° C.).

Due to the nature of the thermal cracking process as described above, about 30 wt % to about 80 wt % of the 1050° F.+ (566° C.) portion of the feed was converted to compounds in a lower boiling range. This means that a substantial portion of the product boils above 1050° F.+ (566° C.) and is present in one or more higher boiling portions separated from the thermal cracking effluent. Some of these 1050° F.+ compounds in the effluent can correspond to lower value compounds. Such compounds can be removed by exposing the 700° F.+ (370° C.) portion, or 750° F.+ (400° C.) portion, or 800° F.+ (427° C.) portion, of the thermal cracking effluent to a deasphalting process, a solvent extraction process for aromatics removal, or a combination thereof. Depending on the aspect, all of the 700° F.+ portion (or 750° F.+ portion, or 800° F.+ portion) can be exposed to the deasphalting and/or the solvent extraction process. Alternatively, the 700° F.+ portion (or 750° F.+ portion, or 800° F.+ portion) may correspond to a plurality of higher boiling portions. In this situation, one or more of the higher boiling portions may not be exposed to the deasphalting and/or the solvent extraction process. As an example, it may be preferable to form a 650° F.-750° F. (343° C.-400° C.) portion or a 700° F.-800° F. portion (370° C.-427° C.) (corresponding to a vacuum gas oil boiling range portion) and a 800° F.+ (427° C.) resid portion. In such an example, it may be desirable to perform solvent deasphalting on only the resid portion. Additionally or alternately, it may be desirable to perform solvent extraction on only the deasphalted oil generated from solvent deasphalting of the resid portion.

Solvent deasphalting is a solvent extraction process. Typical solvents include alkanes or other hydrocarbons containing about 3 to about 6 carbons per molecule. Examples of suitable solvents include propane, n-butane, isobutane, and n-pentane. Alternatively, other types of solvents may also be suitable, such as supercritical fluids. During solvent deasphalting, a feed portion is mixed with the solvent. Portions of the feed that are soluble in the solvent are then extracted, leaving behind a residue with little or no solubility in the solvent. Typical solvent deasphalting conditions include mixing a feedstock fraction with a solvent in a weight ratio of from about 1:2 to about 1:10, such as about 1:8 or less. Typical solvent deasphalting temperatures range from about 40° C. to about 150° C. The pressure during solvent deasphalting can be from about 50 psig (345 kPag) to about 500 psig (3447 kPag).

The portion of the deasphalted feedstock that is extracted with the solvent is often referred to as deasphalted oil. In various aspects, the bottoms from vacuum distillation can be used as the feed to the solvent deasphalter, so the portion extracted with the solvent can also be referred to as deasphalted bottoms. The yield of deasphalted oil from a solvent deasphalting process varies depending on a variety of factors, including the nature of the feedstock, the type of solvent, and the solvent extraction conditions. A lighter molecular weight solvent such as propane will result in a lower yield of deasphalted oil as compared to n-pentane, as fewer components of a bottoms fraction will be soluble in the shorter chain alkane. However, the deasphalted oil resulting from propane deasphalting is typically of higher quality, resulting in expanded options for use of the deasphalted oil. Under typical deasphalting conditions, increasing the temperature will also usually reduce the yield while increasing the quality of the resulting deasphalted oil. In various embodiments, the yield of deasphalted oil from solvent deasphalting can be about 85 wt % or less of the feed to the deasphalting process, or about 75 wt % or less. Preferably, the solvent deasphalting conditions are selected so that the yield of deasphalted oil is at least about 65 wt %, such as at least about 70 wt % or at least about 75 wt %. The deasphalted oil resulting from the solvent deasphalting procedure can then be optionally exposed to a solvent extraction process. Optionally, if a vacuum gas oil boiling range portion was formed that was not exposed to solvent deasphalting, the vacuum gas oil boiling range portion can be combined with the deasphalted oil prior to solvent extraction, after solvent extraction, or a combination thereof. After a deasphalting process, the yield of deasphalting residue is typically at least about 15 wt % of the feed to the deasphalting process, but is preferably about 35 wt % or less, such as about 30 wt % or less or 25 wt % or less.

Solvent extraction can then be performed on the deasphalted oil generated from the solvent deasphalting process, optionally after combination with other fractions such as additional vacuum gas oil boiling range fractions. Solvent extraction can be used to reduce the aromatics content and/or the amount of polar molecules. The solvent extraction process selectively dissolves aromatic components to form an aromatics-rich extract phase while leaving the more paraffinic components in an aromatics-poor raffinate phase. Naphthenes are distributed between the extract and raffinate phases. Typical solvents for solvent extraction include phenol, furfural and N-methyl pyrrolidone. By controlling the solvent to oil ratio, extraction temperature and method of contacting distillate to be extracted with solvent, one can control the degree of separation between the extract and raffinate phases. Any convenient type of liquid-liquid extractor can be used, such as a counter-current liquid-liquid extractor. Depending on the initial concentration of aromatics in the deasphalted oil, the raffinate phase can have an aromatics content of about 5 wt % to about 25 wt %. For typical feeds, the aromatics contents will be at least about 10 wt %.

In some aspects, the deasphalted oil and the additional vacuum gas oil boiling range fractions (or other additional fractions) can be solvent processed together. Alternatively, the deasphalted bottoms and the additional vacuum gas oil boiling range fractions can be solvent processed separately, to facilitate formation of different types of lubricant base oils. More generally, any convenient number of fractions can be formed from the deasphalted oil and/or additional higher boiling fractions to allow for separate solvent processing if desired.

The raffinate from the solvent extraction is preferably under-extracted. In such preferred aspects, the extraction is carried out under conditions such that the raffinate yield is maximized while still removing most of the lowest quality molecules from the feed. Raffinate yield may be maximized by controlling extraction conditions, for example, by lowering the solvent to oil treat ratio and/or decreasing the extraction temperature. In various aspects, the raffinate yield from solvent extraction can be at least about 25 wt %, or at least about 30 wt %, or at least about 40 wt %, or at least about 50 wt %.

In other aspects, the solvent extraction for aromatics removal can be omitted, and the deasphalted oil can be dewaxed and/or hydrofinished to form lubricant base oil products. In still other aspects, the deasphalted oil can be hydrocracked.

In various aspects, the deasphalted oil, the raffinate from solvent extraction of the deasphalted oil, and/or the hydrocracked deasphalted oil can have a desirable combination of viscosity index and viscosity at 100° C. For example, the deasphalted oil, the raffinate from solvent extraction of the deasphalted oil, and/or the hydrocracked deasphalted oil can have a viscosity index of at least about 50, or at least about 60, or at least about 70, or at least about 75, or at least about 80, or at least about 85, or at least about 90, such as up to about 120 or more. In such aspects, the deasphalted oil, the raffinate from solvent extraction of the deasphalted oil, and/or the hydrocracked deasphalted oil can have such a viscosity index in combination with having a viscosity at 100° C. of at least about 7.0 cSt, or at least about 7.5 cSt, or at least about 8.0 cSt, or at least about 8.5 cSt, or at least about 9.0 cSt, such as up to about 25 cSt or more.

Processing of Thermally Cracked Resid—Optional Hydrotreating

After deasphalting and optional solvent extraction, the deasphalted oil (and any additional fractions combined with the deasphalted oil) can undergo further processing to form lubricant base oils. This can include an optional additional hydrotreatment to remove heteroatoms to desired levels, optional additional hydrocracking, and dewaxing and hydrofinishing to produce lubricant base oils at a given viscosity with a desired pour point and/or viscosity index.

In various aspects, the deasphalted oil (after optional solvent extraction) can be exposed to a hydrotreating catalyst under effective hydrotreating conditions. The catalysts used can include conventional hydroprocessing catalysts, such as those comprising at least one Group VIII non-noble metal (Columns 8-10 of IUPAC periodic table), preferably Fe, Co, and/or Ni, such as Co and/or Ni; and at least one Group VI metal (Column 6 of IUPAC periodic table), preferably Mo and/or W. Such hydroprocessing catalysts optionally include transition metal sulfides that are impregnated or dispersed on a refractory support or carrier such as alumina and/or silica. The support or carrier itself typically has no significant/measurable catalytic activity. Substantially carrier- or support-free catalysts, commonly referred to as bulk catalysts, generally have higher volumetric activities than their supported counterparts.

The catalysts can either be in bulk form or in supported form. In addition to alumina and/or silica, other suitable support/carrier materials can include, but are not limited to, zeolites, titania, silica-titania, and titania-alumina. Suitable aluminas are porous aluminas such as gamma or eta having average pore sizes from 50 to 200 Å, or 75 to 150 Å; a surface area from 100 to 300 $m^2/g$, or 150 to 250 $m^2/g$; and a pore volume of from 0.25 to 1.0 cm/g, or 0.35 to 0.8 cm/g. More generally, any convenient size, shape, and/or pore size distribution for a catalyst suitable for hydrotreatment of a distillate (including lubricant base oil) boiling range feed in a conventional manner may be used. Preferably, the support or carrier material is an amorphous support, such as a refractory oxide. Preferably, the support or carrier material can be free or substantially free of the presence of molecular sieve, where substantially free of molecular sieve is defined as having a content of molecular sieve of less than about 0.01 wt %.

The at least one Group VIII non-noble metal, in oxide form, can typically be present in an amount ranging from about 2 wt % to about 40 wt %, preferably from about 4 wt % to about 15 wt %. The at least one Group VI metal, in oxide form, can typically be present in an amount ranging from about 2 wt % to about 70 wt %, preferably for supported catalysts from about 6 wt % to about 40 wt % or from about 10 wt % to about 30 wt %. These weight percents are based on the total weight of the catalyst. Suitable metal catalysts include cobalt/molybdenum (1-10% Co as oxide, 10-40% Mo as oxide), nickel/molybdenum (1-10% Ni as oxide, 10-40% Co as oxide), or nickel/tungsten (1-10/Ni as oxide, 10-40% W as oxide) on alumina, silica, silica-alumina, or titania.

The hydrotreatment is carried out in the presence of hydrogen. A hydrogen stream is, therefore, fed or injected into a vessel or reaction zone or hydroprocessing zone in which the hydroprocessing catalyst is located. Hydrogen, which is contained in a hydrogen "treat gas," is provided to the reaction zone. Treat gas, as referred to in this disclosure, can be either pure hydrogen or a hydrogen-containing gas, which is a gas stream containing hydrogen in an amount that is sufficient for the intended reaction(s), optionally including one or more other gasses (e.g., nitrogen and light hydrocarbons such as methane), and which will not adversely interfere with or affect either the reactions or the products. Impurities, such as HS and $NH_3$ are undesirable and would typically be removed from the treat gas before it is conducted to the reactor. The treat gas stream introduced into a reaction stage will preferably contain at least about 50 vol. % and more preferably at least about 75 vol. % hydrogen.

Hydrogen can be supplied at a rate of from about 100 SCF/B (standard cubic feet of hydrogen per barrel of feed) (17 $Nm/m^3$) to about 1500 SCF/B (253 $Nm^3/m^3$). Preferably, the hydrogen is provided in a range of from about 200 SCF/B (34 $Nm^3/m^3$) to about 1200 SCF/B (202 $Nm/m^3$). Hydrogen can be supplied co-currently with the input feed to the hydrotreatment reactor and/or reaction zone or separately via a separate gas conduit to the hydrotreatment zone.

Hydrotreating conditions can include temperatures of 200° C. to 450° C., or 315° C. to 425° C.; pressures of 250 psig (1.8 MPag) to 5000 psig (34.6 MPag) or 300 psig (2.1 MPag) to 3000 psig (20.8 MPag); liquid hourly space velocities (LHSV) of 0.1 $hr^{-1}$ to 10 $hr^{-1}$; and hydrogen treat rates of 200 scf/B (35.6 $m^3/m^3$) to 10,000 scf/B (1781 $m^3/m^3$), or 500 (89 $m^3/m^3$) to 10,000 scf/B (1781 $m^3/m^3$).

Hydrotreatment of the deasphalted oil can be omitted if the thermal conversion process reduces the sulfur level of the feed to a sufficiently low level. For example, for feeds with sulfur contents of less than about 1.0 wt %, or less than about 2.0 wt %, or less than about 2.5 wt %, thermal processing of the feed to achieve 30 wt % to 70 wt % conversion of the 1050° F.+ portion of the feed may be sufficient to reduce the sulfur and/or nitrogen content of the feed to a suitable level for use as a lubricant base oil. It is noted that the deasphalting process can also remove some sulfur, as some of the more difficult to remove sulfur compounds can correspond to asphaltenes. When the deasphalted oil is hydrotreated, the hydrotreating conditions can be selected to reduce the sulfur content of the hydrotreated deasphalted oil to about 0.03 wt % (300 wppm) or less, such as about 0.02 wt % or less, or about 0.01 wt % or less. Optionally, hydrotreatment can be used in order to reduce the nitrogen content of the deasphalted oil to a desired level.

Processing of Thermally Cracked Resid—Optional Hydrocracking

In various aspects, the deasphalted oil (after optional solvent extraction) can be exposed to a hydrocracking catalyst under effective hydrocracking conditions. The reaction conditions in the hydrocracking stage(s) in a reaction system can be selected to generate a desired level of conversion of a feed. Conversion of the feed can be defined in terms of conversion of molecules that boil above a temperature threshold to molecules below that threshold. The conversion temperature can be any convenient temperature, such as about 700° F. (371° C.) or about 725° F. (385° C.). The amount of conversion can correspond to the total conversion of molecules within any hydrocracking stage. Suitable amounts of conversion of molecules boiling above 725° F. to molecules boiling below 725° F. include converting at least 10% of the 725° F.+ portion of the feedstock to the stage(s) of the reaction system, such as at least 20% of the 725° F.+ portion, or at least 30%. Additionally or alternately, the amount of conversion for the reaction system can be about 85% or less of the 725° F.+ portion, or about 70% or less, or about 55% or less, or about 40% or less. Still larger amounts of conversion may also produce a suitable hydrocracker bottoms for forming lubricant base oils, but such higher conversion amounts will also result in a reduced yield of lubricant base oils. Reducing the amount of conversion can increase the yield of lubricant base oils, but reducing the amount of conversion to below the ranges noted above may result in hydrocracker bottoms that are not suitable for formation of Group II, Group II+, or Group III lubricant base oils.

In order to achieve a desired level of conversion, a reaction system can include at least one hydrocracking catalyst. Hydrocracking catalysts typically contain sulfided base metals on acidic supports, such as amorphous silica alumina, cracking zeolites such as USY, or acidified alumina. Often these acidic supports are mixed or bound with other metal oxides such as alumina, titania or silica. Examples of suitable acidic supports include acidic molecular sieves, such as zeolites or silicoaluminophophates. One example of suitable zeolite is USY, such as a USY zeolite with cell size of 24.30 Angstroms or less. Additionally or alternately, the catalyst can be a low acidity molecular sieve, such as a USY zeolite with a Si to Al ratio of at least about 20, and preferably at least about 40 or 50. ZSM-48, such as ZSM-48 with a $SiO_2$ to $Al_2O_3$ ratio of about 110 or less, such as about 90 or less, is another example of a potentially suitable hydrocracking catalyst. Still another option is to use a combination of USY and ZSM-48. Still other options include using one or more of zeolite Beta, ZSM-5, ZSM-35, or ZSM-23, either alone or in combination with a USY catalyst. Non-limiting examples of metals for hydrocracking catalysts include metals or combinations of metals that include at least one Group VIII metal, such as nickel, nickel-cobalt-molybdenum, cobalt-molybdenum, nickel-tungsten, nickel-molybdenum, and/or nickel-molybdenum-tungsten. Additionally or alternately, hydrocracking catalysts with noble metals can also be used. Non-limiting examples of noble metal catalysts include those based on platinum and/or palladium. Support materials which may be used for both the noble and non-noble metal catalysts can comprise a refractory oxide material such as alumina, silica, alumina-silica, kieselguhr, diatomaceous earth, magnesia, zirconia, or combinations thereof, with alumina, silica, alumina-silica being the most common (and preferred, in one embodiment).

When only one hydrogenation metal is present on a hydrocracking catalyst, the amount of that hydrogenation metal can be at least about 0.1 wt % based on the total weight of the catalyst, for example at least about 0.5 wt % or at least about 0.6 wt %. Additionally or alternately when only one hydrogenation metal is present, the amount of that hydrogenation metal can be about 5.0 wt % or less based on the total weight of the catalyst, for example about 3.5 wt % or less, about 2.5 wt % or less, about 1.5 wt % or less, about 1.0 wt % or less, about 0.9 wt % or less, about 0.75 wt % or less, or about 0.6 wt % or less. Further additionally or alternately when more than one hydrogenation metal is present, the collective amount of hydrogenation metals can be at least about 0.1 wt % based on the total weight of the catalyst, for example at least about 0.25 wt %, at least about 0.5 wt %, at least about 0.6 wt %, at least about 0.75 wt %, or at least about 1 wt %. Still further additionally or alternately when more than one hydrogenation metal is present, the collective amount of hydrogenation metals can be about 35 wt % or less based on the total weight of the catalyst, for example about 30 wt % or less, about 25 wt % or less, about 20 wt % or less, about 15 wt % or less, about 10 wt % or less, or about 5 wt % or less. In embodiments wherein the supported metal comprises a noble metal, the amount of noble metal(s) is typically less than about 2 wt %, for example less than about 1 wt %, about 0.9 wt % or less, about 0.75 wt % or less, or about 0.6 wt % or less.

In various aspects, the conditions selected for hydrocracking for lubricant base stock production can depend on the desired level of conversion, the level of contaminants in the input feed to the hydrocracking stage, and potentially other factors. For example, hydrocracking conditions in a single stage, or in the first stage and/or the second stage of a multi-stage system, can be selected to achieve a desired level of conversion in the reaction system. Hydrocracking conditions can be referred to as sour conditions or sweet conditions, depending on the level of sulfur and/or nitrogen present within a feed. For example, a feed with 100 wppm or less of sulfur and 50 wppm or less of nitrogen, preferably less than 25 wppm sulfur and/or less than 10 wppm of nitrogen, represent a feed for hydrocracking under sweet conditions. In various aspects, hydrocracking can be performed on a thermally cracked resid, such as a deasphalted oil derived from a thermally cracked resid. In some aspects, such as aspects where an optional hydrotreating step is used prior to hydrocracking, the thermally cracked resid may correspond to a sweet feed. In other aspects, the thermally cracked resid may represent a feed for hydrocracking under sour conditions.

A hydrocracking process under sour conditions can be carried out at temperatures of about 550° F. (288° C.) to about 840° F. (449° C.), hydrogen partial pressures of from about 1500 psig to about 5000 psig (10.3 MPag to 34.6 MPag), liquid hourly space velocities of from 0.05 $h^{-1}$ to 10 $h^{-1}$, and hydrogen treat gas rates of from 35.6 $m^3/m^3$ to 1781 $m^3/m^3$ (200 SCF/B to 10,000 SCFB). In other embodiments, the conditions can include temperatures in the range of about 600° F. (343° C.) to about 815° F. (435° C.), hydrogen partial pressures of from about 1500 psig to about 3000 psig (10.3 MPag-20.9 MPag), and hydrogen treat gas rates of from about 213 $m^3/m^3$ to about 1068 $m^3/m^3$ (1200 SCF/B to 6000 SCF/B). The LHSV relative to only the hydrocracking catalyst can be from about 0.25 $h^{-1}$ to about 50 h, such as from about 0.5 $h^{-1}$ to about 20 $h^{-1}$, and preferably from about 1.0 $h^{-1}$ to about 4.0 $h^{-1}$.

In some aspects, a portion of the hydrocracking catalyst can be contained in a second reactor stage. In such aspects, a first reaction stage of the hydroprocessing reaction system can include one or more hydrotreating and/or hydrocracking catalysts. The conditions in the first reaction stage can be suitable for reducing the sulfur and/or nitrogen content of the feedstock. A separator can then be used in between the first and second stages of the reaction system to remove gas phase sulfur and nitrogen contaminants. One option for the separator is to simply perform a gas-liquid separation to remove contaminant. Another option is to use a separator such as a flash separator that can perform a separation at a higher temperature. Such a high temperature separator can be used, for example, to separate the feed into a portion boiling below a temperature cut point, such as about 350° F. (177° C.) or about 400° F. (204° C.), and a portion boiling above the temperature cut point. In this type of separation, the naphtha boiling range portion of the effluent from the first reaction stage can also be removed, thus reducing the volume of effluent that is processed in the second or other subsequent stages. Of course, any low boiling contaminants in the effluent from the first stage would also be separated into the portion boiling below the temperature cut point. If sufficient contaminant removal is performed in the first stage, the second stage can be operated as a "sweet" or low contaminant stage.

Still another option can be to use a separator between the first and second stages of the hydroprocessing reaction system that can also perform at least a partial fractionation of the effluent from the first stage. In this type of aspect, the effluent from the first hydroprocessing stage can be separated into at least a portion boiling below the distillate (such as diesel) fuel range, a portion boiling in the distillate fuel range, and a portion boiling above the distillate fuel range. The distillate fuel range can be defined based on a conventional diesel boiling range, such as having a lower end cut point temperature of at least about 350° F. (177° C.) or at least about 400° F. (204° C.) to having an upper end cut point temperature of about 700° F. (371° C.) or less or 650° F. (343° C.) or less. Optionally, the distillate fuel range can be extended to include additional kerosene, such as by selecting a lower end cut point temperature of at least about 300° F. (149° C.).

In aspects where the inter-stage separator is also used to produce a distillate fuel fraction, the portion boiling below the distillate fuel fraction includes, naphtha boiling range molecules, light ends, and contaminants such as $H_2S$. These different products can be separated from each other in any convenient manner. Similarly, one or more distillate fuel fractions can be formed, if desired, from the distillate boiling range fraction. The portion boiling above the distillate fuel range represents the potential lubricant base oils. In such aspects, the portion boiling above the distillate fuel range is subjected to further hydroprocessing in a second hydroprocessing stage.

A hydrocracking process under sweet conditions can be performed under conditions similar to those used for a sour hydrocracking process, or the conditions can be different. In an embodiment, the conditions in a sweet hydrocracking stage can have less severe conditions than a hydrocracking process in a sour stage. Suitable hydrocracking conditions for a non-sour stage can include, but are not limited to, conditions similar to a first or sour stage. Suitable hydrocracking conditions can include temperatures of about 550° F. (288° C.) to about 840° F. (449° C.), hydrogen partial pressures of from about 1500 psig to about 5000 psig (10.3 MPag to 34.6 MPag), liquid hourly space velocities of from 0.05 $h^{-1}$ to 10 $h^{-1}$, and hydrogen treat gas rates of from 35.6 $m^3/m^3$ to 1781 $m^3/m^3$ (200 SCF/B to 10,000 SCF/B). In other embodiments, the conditions can include temperatures in the range of about 600° F. (343° C.) to about 815° F. (435° C.), hydrogen partial pressures of from about 1500 psig to about 3000 psig (10.3 MPag-20.9 MPag), and hydrogen treat gas rates of from about 213 $m^3/m^3$ to about 1068 $m^3/m^3$ (1200 SCF/B to 6000 SCF/B). The liquid hourly space velocity can vary depending on the relative amount of hydrocracking catalyst used versus dewaxing catalyst. Relative to the combined amount of hydrocracking and dewaxing catalyst, the LHSV can be from about 0.2 $h^{-1}$ to about 10 $h^{-1}$, such as from about 0.5 $h^{-1}$ to about 5 $h^{-1}$ and/or from about 1 $h^{-1}$ to about 4 $h^{-1}$. Depending on the relative amount of hydrocracking catalyst and dewaxing catalyst used, the LHSV relative to only the hydrocracking catalyst can be from about 0.25 $h^{-1}$ to about 50 $h^{-1}$, such as from about 0.5 $h^{-1}$ to about 20 $h^{-1}$, and preferably from about 1.0 $h^{-1}$ to about 4.0 $h^{-1}$.

In still another aspect, the same conditions can be used for hydrotreating and hydrocracking beds or stages, such as using hydrotreating conditions for both or using hydrocracking conditions for both. In yet another embodiment, the pressure for the hydrotreating and hydrocracking beds or stages can be the same.

In yet another aspect, a hydroprocessing reaction system may include more than one hydrocracking stage. If multiple hydrocracking stages are present, at least one hydrocracking stage can have effective hydrocracking conditions as described above, including a hydrogen partial pressure of at least about 1500 psig (10.3 MPag). In such an aspect, other hydrocracking processes can be performed under conditions that may include lower hydrogen partial pressures. Suitable hydrocracking conditions for an additional hydrocracking stage can include, but are not limited to, temperatures of about 550° F. (288° C.) to about 840° F. (449° C.), hydrogen partial pressures of from about 250 psig to about 5000 psig (1.8 MPag to 34.6 MPag), liquid hourly space velocities of from 0.05 $h^{-1}$ to 10 $h^{-1}$, and hydrogen treat gas rates of from 35.6 $m^3/m$ to 1781 $m^3/m^3$ (200 SCF/B to 10,000 SCF/B). In other embodiments, the conditions for an additional hydrocracking stage can include temperatures in the range of about 600° F. (343° C.) to about 815° F. (435° C.), hydrogen partial pressures of from about 500 psig to about 3000 psig (3.5 MPag-20.9 MPag), and hydrogen treat gas rates of from about 213 $m^3/m^3$ to about 1068 $m^3/m^3$ (1200 SCF/B to 6000 SCF/B). The liquid hourly space velocity can vary depending on the relative amount of hydrocracking catalyst used versus dewaxing catalyst. Relative to the combined amount of hydrocracking and dewaxing catalyst, the LHSV can be from about 0.2 h- to about 10 $h^{-1}$, such as from about 0.5 $h^{-1}$ to about 5 h- and/or from about 1 $h^{-1}$ to about 4 $h^{-1}$. Depending on the relative amount of hydrocracking catalyst and dewaxing catalyst used, the LHSV relative to only the hydrocracking catalyst can be from about 0.25 $h^{-1}$ to about 50 $h^{-1}$, such as from about 0.5 $h^{-1}$ to about 20 $h^{-1}$, and preferably from about 1.0 $h^{-1}$ to about 4.0 $h^{-1}$.

Processing of Thermally Cracked Resid—Dewaxing Processes

After any optional hydrotreatment, the deasphalted oil can be catalytically dewaxed or solvent dewaxed to produce one or more lubricant base oil fractions. Solvent dewaxing is more commonly used to form Group I base oils. Catalytic dewaxing is more commonly used for production of Group H or Group III base oils. It is noted that fractionation of the dewaxing effluent into lubricant base oil fractions is typically performed after dewaxing, but fractionation can alternatively be performed prior to dewaxing if desired.

For catalytic dewaxing, suitable dewaxing catalysts can include molecular sieves such as crystalline aluminosilicates (zeolites). In an embodiment, the molecular sieve can comprise, consist essentially of, or be ZSM-22, ZSM-23, ZSM-48. Optionally but preferably, molecular sieves that are selective for dewaxing by isomerization as opposed to cracking can be used, such as ZSM-48, ZSM-23, or a combination thereof. Additionally or alternately, the molecular sieve can comprise, consist essentially of, or be a 10-member ring 1-D molecular sieve, such as EU-2, EU-11, ZBM-30, ZSM-48, or ZSM-23. ZSM-48 is most preferred. Note that a zeolite having the ZSM-23 structure with a silica to alumina ratio of from about 20:1 to about 40:1 can sometimes be referred to as SSZ-32. Optionally but preferably, the dewaxing catalyst can include a binder for the molecular sieve, such as alumina, titania, silica, silica-alumina, zirconia, or a combination thereof, for example alumina and/or titania or silica and/or zirconia and/or titania.

Preferably, the dewaxing catalysts used in processes according to the disclosure are catalysts with a low ratio of silica to alumina. For example, for ZSM-48, the ratio of silica to alumina in the zeolite can be about 100:1 or less, such as about 90:1 or less, or about 75:1 or less, or about 70:1 or less. Additionally or alternately, the ratio of silica to alumina in the ZSM-48 can be at least about 50:1, such as at least about 60:1, or at least about 65:1.

In various embodiments, the catalysts according to the disclosure further include a metal hydrogenation component. The metal hydrogenation component is typically a Group VI and/or a Group VIII metal. Preferably, the metal hydrogenation component can be a combination of a non-noble Group VIII metal with a Group VI metal. Suitable combinations can include Ni, Co, or Fe with Mo or W, preferably Ni with Mo or W.

The metal hydrogenation component may be added to the catalyst in any convenient manner. One technique for adding the metal hydrogenation component is by incipient wetness. For example, after combining a zeolite and a binder, the combined zeolite and binder can be extruded into catalyst particles. These catalyst particles can then be exposed to a solution containing a suitable metal precursor. Alternatively, metal can be added to the catalyst by ion exchange, where a metal precursor is added to a mixture of zeolite (or zeolite and binder) prior to extrusion.

The amount of metal in the catalyst can be at least 0.1 wt % based on catalyst, or at least 0.5 wt %, or at least 1.0 wt %, or at least 2.5 wt %, or at least 5.0 wt %, based on catalyst. The amount of metal in the catalyst can be 20 wt % or less based on catalyst, or 10 wt % or less, or 5 wt % or less, or 2.5 wt % or less, or 1 wt % or less. For embodiments where the metal is a combination of a non-noble Group VIII metal with a Group VI metal, the combined amount of metal can be from 0.5 wt % to 20 wt %, or 1 wt % to 15 wt %, or 2.5 wt % to 10 wt %.

The dewaxing catalysts useful in processes according to the disclosure can also include a binder. In some embodiments, the dewaxing catalysts used in process according to the disclosure are formulated using a low surface area binder, a low surface area binder represents a binder with a surface area of 100 $m^2/g$ or less, or 80 $m^2/g$ or less, or 70 $m^2/g$ or less. Additionally or alternately, the binder can have a surface area of at least about 25 $m^2/g$. The amount of zeolite in a catalyst formulated using a binder can be from about 30 wt % zeolite to 90 wt % zeolite relative to the combined weight of binder and zeolite. Preferably, the amount of zeolite is at least about 50 wt % of the combined weight of zeolite and binder, such as at least about 60 wt % or from about 65 wt % to about 80 wt %.

Without being bound by any particular theory, it is believed that use of a low surface area binder reduces the amount of binder surface area available for the hydrogenation metals supported on the catalyst. This leads to an increase in the amount of hydrogenation metals that are supported within the pores of the molecular sieve in the catalyst.

A zeolite can be combined with binder in any convenient manner. For example, a bound catalyst can be produced by starting with powders of both the zeolite and binder, combining and mulling the powders with added water to form a mixture, and then extruding the mixture to produce a bound catalyst of a desired size. Extrusion aids can also be used to modify the extrusion flow properties of the zeolite and binder mixture. The amount of framework alumina in the catalyst may range from 0.1 to 3.33 wt %, or 0.1 to 2.7 wt %, or 0.2 to 2 wt %, or 0.3 to 1 wt %.

Effective conditions for catalytic dewaxing of a feedstock in the presence of a dewaxing catalyst can include a temperature of from 300° C. to 450° C., preferably 343° C. to 435° C., a hydrogen partial pressure of from 3.5 MPag to 34.6 MPag (500 psig to 5000 psig), preferably 4.8 MPag to 20.8 MPag, and a hydrogen circulation rate of from 178 $m^3/m^3$ (1000 SCF/B) to 1781 $m^3/m^3$ (10,000 scf/B), preferably 213 $m^3/m^3$ (1200 SCF/B) to 1068 $m^3/m^3$ (6000 SCF/B). The LHSV can be from about 0.2 $h^{-1}$ to about 10 $h^{-1}$, such as from about 0.5 $h^{-1}$ to about 5 $h^{-1}$ and/or from about 1 $h^{-1}$ to about 4 $h^{-1}$.

Solvent dewaxing typically involves mixing a feed with chilled dewaxing solvent to form an oil-solvent solution. Precipitated wax is thereafter separated by, for example, filtration. The temperature and solvent are selected so that the oil is dissolved by the chilled solvent while the wax is precipitated.

An example of a suitable solvent dewaxing process involves the use of a cooling tower where solvent is prechilled and added incrementally at several points along the height of the cooling tower. The oil-solvent mixture is agitated during the chilling step to permit substantially instantaneous mixing of the prechilled solvent with the oil. The prechilled solvent is added incrementally along the length of the cooling tower so as to maintain an average chilling rate at or below 10° F. per minute, usually between about 1 to about 5° F. per minute. The final temperature of the oil-solvent/precipitated wax mixture in the cooling tower will usually be between 0 and 50° F. (−17.8 to 10° C.). The mixture may then be sent to a scraped surface chiller to separate precipitated wax from the mixture.

Representative dewaxing solvents are aliphatic ketones having 3-6 carbon atoms such as methyl ethyl ketone and methyl isobutyl ketone, low molecular weight hydrocarbons such as propane and butane, and mixtures thereof. The solvents may be mixed with other solvents such as benzene, toluene or xylene.

In general, the amount of solvent added will be sufficient to provide a liquid/solid weight ratio between the range of 5/1 and 20/1 at the dewaxing temperature and a solvent/oil volume ratio between 1.5/1 to 5/1. The solvent dewaxed oil is typically dewaxed to an intermediate pour point, preferably less than about +10° C., such as less than about 5° C. or less than about 0° C. The resulting solvent dewaxed oil is suitable for use in forming one or more types of Group I base oils. The aromatics content will typically be greater than 10 wt % in the solvent dewaxed oil. Additionally, the sulfur content of the solvent dewaxed oil will typically be greater than 300 wppm.

Processing of Thermally Cracked Resid—Hydrofinishing and/or Aromatic Saturation

A hydrofinishing and/or aromatic saturation stage can also be provided. As noted above, due to the presence of multi-ring aromatics that remain after partial conversion, aromatic saturation of the partially converted feed can lead to an unexpected increase in viscosity index.

The hydrofinishing and/or aromatic saturation stage can occur after the last bed of any optional hydrotreating catalyst. The hydrofinishing and/or aromatic saturation can occur either before or after dewaxing. The hydrofinishing and/or aromatic saturation can occur either before or after fractionation. If hydrofinishing and/or aromatic saturation occurs after fractionation, the hydrofinishing can be performed on one or more portions of the fractionated product, such as being performed on the bottoms from a prior reaction stage (such as hydrocracker bottoms). Alternatively, the entire effluent from the last hydrocracking or dewaxing process can be hydrofinished and/or undergo aromatic saturation.

In some situations, a hydrofinishing process and an aromatic saturation process can refer to a single process performed using the same catalyst. Alternatively, one type of catalyst or catalyst system can be provided to perform aromatic saturation, while a second catalyst or catalyst system can be used for hydrofinishing. Typically a hydrofinishing and/or aromatic saturation process will be performed in a separate reactor from dewaxing or hydrocracking processes for practical reasons, such as facilitating use of a lower temperature for the hydrofinishing or aromatic saturation process. However, an additional hydrofinishing reactor following a hydrocracking or dewaxing process but prior to fractionation could still be considered part of a second stage of a reaction system conceptually.

Hydrofinishing and/or aromatic saturation catalysts can include catalysts containing Group VI metals, Group VIII metals, and mixtures thereof. In an embodiment, preferred metals include at least one metal sulfide having a strong hydrogenation function. In another embodiment, the hydrofinishing catalyst can include a Group VIII noble metal, such as Pt, Pd, or a combination thereof. The mixture of metals may also be present as bulk metal catalysts wherein the amount of metal is about 30 wt. % or greater based on catalyst. Suitable metal oxide supports include low acidic oxides such as silica, alumina, silica-aluminas or titania, preferably alumina. The preferred hydrofinishing catalysts for aromatic saturation will comprise at least one metal having relatively strong hydrogenation function on a porous support. Typical support materials include amorphous or crystalline oxide materials such as alumina, silica, and silica-alumina. The support materials may also be modified, such as by halogenation, or in particular fluorination. The metal content of the catalyst is often as high as about 20 weight percent for non-noble metals. In an embodiment, a preferred hydrofinishing catalyst can include a crystalline material belonging to the M41S class or family of catalysts. The M41S family of catalysts are mesoporous materials having high silica content. Examples include MCM-41, MCM-48 and MCM-50. A preferred member of this class is MCM-41. If separate catalysts are used for aromatic saturation and hydrofinishing, an aromatic saturation catalyst can be selected based on activity and/or selectivity for aromatic saturation, while a hydrofinishing catalyst can be selected based on activity for improving product specifications, such as product color and polynuclear aromatic reduction.

Hydrofinishing conditions can include temperatures from about 125° C. to about 425° C., preferably about 180° C. to about 280° C., a hydrogen partial pressure from about 500 psig (3.4 MPa) to about 3000 psig (20.7 MPa), preferably about 1500 psig (10.3 MPa) to about 2500 psig (17.2 MPa), and liquid hourly space velocity from about 0.1 $hr^{-1}$ to about 5 $hr^{-1}$ LHSV, preferably about 0.5 $hr^{-1}$ to about 1.5 $hr^{-1}$. Additionally, a hydrogen treat gas rate of from 35.6 $m^3/m^3$ to 1781 $m^3/m^3$ (200 SCF/B to 10,000 SCF/B) can be used. Optionally but preferably, the temperature in the hydrofinishing stage can be lower than the temperature of the effective hydrotreating conditions.

Lubricant Base Oil Products

After exposing a feedstock to the dewaxing catalyst (and optionally a hydrotreating catalyst and/or a hydrofinishing catalyst), the resulting effluent can be separated and/or fractionated to form a plurality of products. Optionally, a first separation can be performed on the effluent to remove light ends and gas phase contaminants, such as $H_2S$ and $NH_3$ generated during the conversion and hydrotreatment processes. The effluent can then be fractionated using one or more separation or fractionation stages to form at least one lubricant product. The at least one lubricant product can correspond to one or more lubricant base oil products having different viscosities. For example, the fractionation can be used to form one or more of a light neutral lubricant base oil product, such as a product with a viscosity of 3 cSt to 6 cSt @ 100° C.; a heavy neutral base oil product, such as a product with a viscosity of 6 cSt to 15 cSt @ 100° C., for example a base oil product with a viscosity greater than 8 cSt @ 100° C. and/or 12 cSt or less @ 100° C.; and a brightstock product, such as a product with a viscosity of 15 cSt to 50 cSt @ 100° C. Other choices for selecting viscosities for a plurality of lubricant base oil products can also be used. Optionally, the fractionation can also result in production of one or more distillate fuel (diesel or kerosene) boiling range products and/or one or more naphtha boiling range products.

In various aspects, the lubricant product(s) can have a pour point of about −15° C. or less, such as about −18° C. or less, or about −20° C. or less. In aspects where the lubricant products are produced after catalytic dewaxing, the lubricant product(s) can have a viscosity index of at least about 90, such as at least about 95, or at least about 103, or at least about 110, or at least about 113, or at least about 120. Optionally, the viscosity index of the lubricant product(s) can be about 160 or less. For lubricant base oils produced from catalytic dewaxing and hydrofinishing, the yield of Group II and/or Group III base oils at higher viscosities can be unexpectedly large. For example, the yield of Group II and/or Group III base oils with a viscosity of at least about 6 cSt @ 100° C. from a paraffin froth treated bitumen can be at least about 10 wt % relative to the 400° F.+ (205° C.) portion of the bitumen, or at least about 12 wt %, or at least about 15 wt %. As another example, the yield of Group II and/or Group III base oils with a viscosity of at least about 6 cSt @ 100° C. can be at least about 15 wt % relative to the 650° F.+ (343° C.) portion of the conventional crude, or at least about 20 wt %, or at least about 25 wt %, or at least about 30 wt %.

Alternative Processing—Naphthenic Base Oil Production

In some alternative aspects, a resid fraction thermally cracked to provide about 30 wt % to about 80 wt % conversion of the 1050° F.+ portion can be further processed using an alternative scheme to generate a high VI naphthenic base oil. In some aspects, the alternative processes can be used for production of novel base stocks with a viscosity index of about 120 or greater and >40 wt % naphthenes. In other aspects, high viscosity base stocks (>15 cst at 100 C) with >20 wt % 3+ ring naphthenes and >80 VI can be produced.

For example, a high viscosity naphthenic base stock can have a kinematic viscosity at 100° C. of at least 10 cSt, or at least 15 cSt, or at least 20 cSt, such as up to 50 cSt or more. Additionally or alternately, a high viscosity naphthenic base stock can include at least 20 wt % naphthenes and/or 3+ ring naphthenes, or at least 25 wt %, or at least 30 wt %, or at least 35 wt %, or at least 40 wt %. Additionally or alternately, a high viscosity naphthenic base stock can have a viscosity index of at least 80, or at least 90, or at least 100, or at least 110, or at least 115, such as up to 120 or more.

It has been discovered that resids can be converted to a full base stock slate (4 to 25 cst base stocks) using thermal cracking (such as coking or hydrovisbreaking) as the first step. The thermal cracking conditions are selected to perform about 30 wt % to about 80 wt % single pass conversion of the 1050° F.+ portion of the resid. The first thermal cracking step produces a product that can be distilled and deasphalted to produce a high viscosity deasphalted oil (DAO) with viscosity index (VI) between 50 and 100. Conventionally it has been believed that saturating the aromatics in DAO's, removing S and N, and hydroisomerizing waxy paraffins does not result in an increase in VI. However, it has been discovered that high viscosity DAO's produced by resid thermal cracking following by deasphalting can undergo 10 to 40 number VI increases when the 3+ ring aromatics in the composition are saturated to naphthenes. The surprising result is a novel high viscosity, high VI base stock with >20 wt % 3+ ring naphthenes.

To produce a high VI naphthenic base oil, after deasphalting, the deasphalted oil can be hydrotreated under effective conditions to produce a hydrotreated deasphalted oil with a sulfur content of about 100 wppm or less. The hydrotreated deasphalted oil can then be dewaxed. The dewaxing effluent can then be hydrofinished to further saturate aromatics within the dewaxing effluent. Optionally, a solvent extraction can be performed prior to hydrotreatment to remove additional 2+ ring aromatics in order to produce an alternative type (higher VI, lower yield) of naphthenic base oil.

Heavy Coker Gas Oil Deasphalting Examples

In various aspects, one of the benefits of using a coking process or other thermal cracking process with a single pass conversion of about 30 wt % to about 80 wt % of the 1050° F.+ (565° C.) portion of a feed (coking with partial conversion) is that additional "asphalt" type compounds can remain after the coking process. A fluidized coking process is an example of a coking process that can be performed with about 50 wt % to about 80 wt % conversion of the 1050° F.+ portion of the feed. Due to the additional "asphalt" type compounds, performing propane deasphalting (or another type of solvent deasphalting) can be performed on a gas oil fraction from such as partial conversion process to produce a) a deasphalted oil and b) an asphalt or rock residual fraction. This is in contrast to a gas oil fraction from a conventional delayed coking process, where attempting to perform solvent deasphalting does not result in formation of separate deasphalted oil and rock fractions.

In some aspects, a difference between delayed coking and fluidized coking/flexicoking can be illustrated based on the boiling point profile of the liquid products generated from the processes. Table 1 shows an example of the liquid product generated from a fluidized coking process operated with about 75 wt % single pass conversion of the 1050° F.+ (565° C.) portion and a recycle point of about 975° F. (525° C.) in comparison with the liquid product from a delayed coking process operated with substantially complete conversion (>90% single pass conversion).

TABLE 1

Characterization of Heavy Coker Gas Oils

| | Fluidized Coker Heavy Coker Gas Oil | Delayed Coker Heavy Coker Gas Oil |
|---|---|---|
| Density (g/cc) | 0.9905 | 0.9471 |
| Gravity (API) | 11.3 | 17.9 |
| Kinematic Viscosity @100° C. (cSt) | 12.9 | 5.2 |
| Carbon Residue MCR (mass %) | 2.84 | 1.5 |
| n-heptane insoluble (mass %) | 0.06 | 0 |
| Pentane insoluble (mass %) | 0.295 | 0.05 |
| Wt % olefins | ~20 wt % | ~10 wt % |
| Distillation T10 | 683° F. (362° C.) | 616° F. (324° C.) |
| Distillation T50 | 831° F. (444° C.) | 778° F. (414° C.) |
| Distillation T90 | 1024° F. (551° C.) | 895° F. (479° C.) |

As shown in Table 1, the heavy coker gas oil produced from fluidized coking includes a substantially greater amount of 900° F.+ (482° C.) or 950° F.+ (510° C.) material relative to the heavy coker gas oil from conventional delayed coking. In particular, about 20 wt % of the fluidized coker gas oil corresponds to 950° F.+ (510° C.) compounds, while less than 3 wt % of the delayed coker gas oil corresponds to 950° F.+ (510° C.) compounds.

The heavy coker gas oil produced from coking at a one-pass conversion rate of 30% to 80% also has an unexpected combination of properties. In some aspects, a thermally cracked gas oil composition can include 2.0 wt % to 5.0 wt % of micro-carbon residue, or 2.5 wt % to 5.0 wt %, or 2.0 wt % to 4.0 wt %, or 2.5 wt % to 4.0 wt %. Additionally or alternately, a thermally cracked gas oil composition can have an API gravity of 15 or less, or 14 or less, or 13 or less, or 12 or less. Additionally or alternately, a thermally cracked gas oil composition can include at least 0.02 wt % of n-heptane insolubles, or at least 0.03 wt %, or at least 0.04 wt %, or at least 0.05 wt %, such as up to about 0.15 wt % or more. Additionally or alternately, a thermally cracked gas oil composition can include 0.1 wt % to 2.0 wt % of pentane insolubles, or 0.2 wt % to 2.0 wt %, or 0.3 wt % to 2.0 wt %, or 0.5 wt % to 2.0 wt %, or 0.1 wt % to 1.5 wt %, or 0.2 wt % to 1.5 wt %, or 0.3 wt % to 1.5 wt %, or 0.5 wt % to 1.5 wt %, or 0.1 wt % to 1.0 wt %, or 0.2 wt % to 1.0 wt %, or 0.3 wt % to 1.0 wt %, or 0.5 wt % to 1.0 wt %. Additionally or alternately, a thermally cracked gas oil composition can include at least 15 wt % olefins, or at least 20 wt % olefins, such as up to 30 wt % or more. Additionally or alternately, a thermally cracked gas oil composition can have a kinematic viscosity at 100° C. of at least 6 cSt, or at least 8 cSt, or at least 10 cSt, or at least 12 cSt, such as up to 32 cSt or more.

The differences in the amount of 950° F.+ material in the heavy coker gas oils can result in distinctive behavior when the gas oils are processed using propane deasphalting. Performing propane deasphalting on the fluidized coker heavy coker gas oil can result in formation of a deasphalted oil and rock under a wide variety of temperature and solvent:oil conditions. Examples of suitable conditions for propane deasphalting include temperatures of about 58° C. to about 88° C. and solvent:oil ratios of about 4:1 to about 8:1. By contrast, due to the low percentage of 950° F.+ (510° C.) compounds in the delayed coker heavy coker gas oil, propane deasphalting does not result in formation of a separated deasphalted oil phase and rock phase. Instead, the heavier compounds that would be expected to form the separate rock phase remain soluble, so that substantially no separation occurs.

In some aspects, the presence of greater amounts of 950° F.+ (510° C.+) compounds in the heavy coker gas oil can allow for additional process options. For example, a lower boiling portion of such a heavy coker gas oil can be used as a feed for lubricant base oil production, while a higher boiling portion of such a heavy coker gas oil can be exposed to solvent deasphalting conditions. The separation of a heavy coker gas oil to form lower boiling and higher boiling portions can be performed at any convenient cut point below 510° C. For example, the separation can be performed so that a higher boiling portion of the heavy coker gas oil is formed that has a T10 boiling point of at least 427° C., or at least 454° C. or at least 482° C., or at least 510° C.

Figure 10:
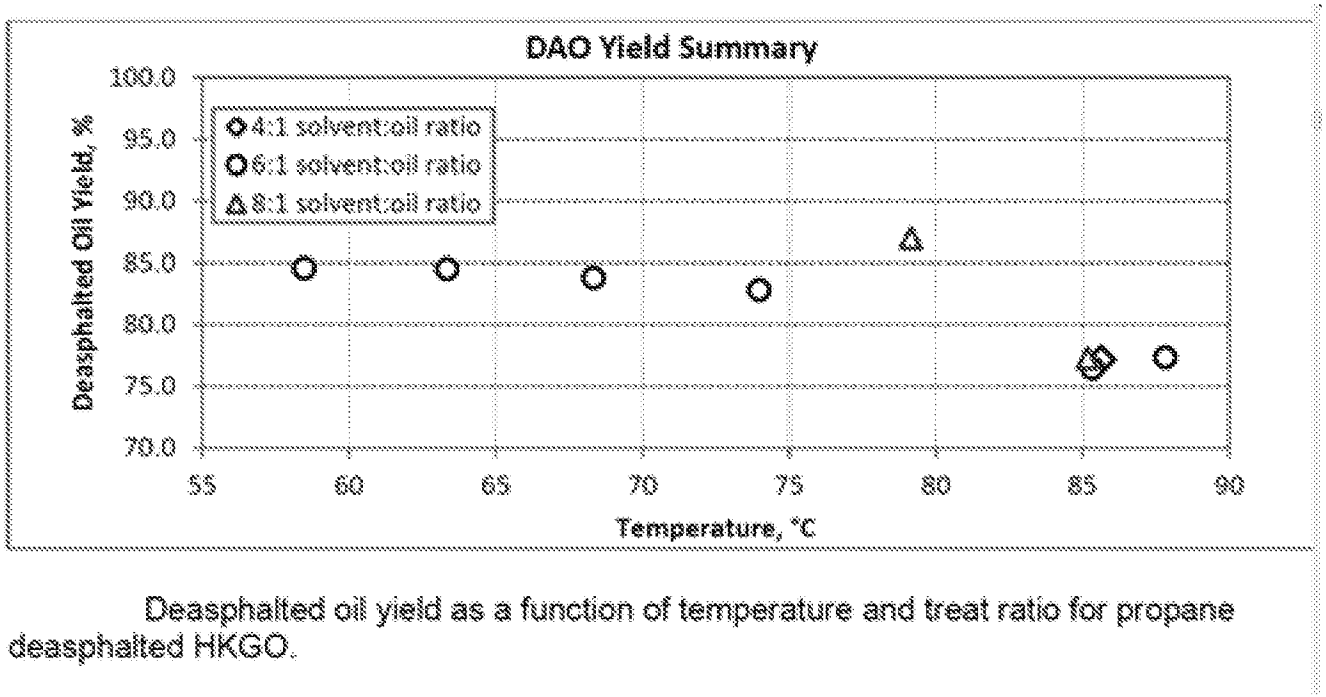
FIG. 10 shows results from performing solvent deasphalting on a heavy coker gas oil from a fluidized coker.
Figure 11:
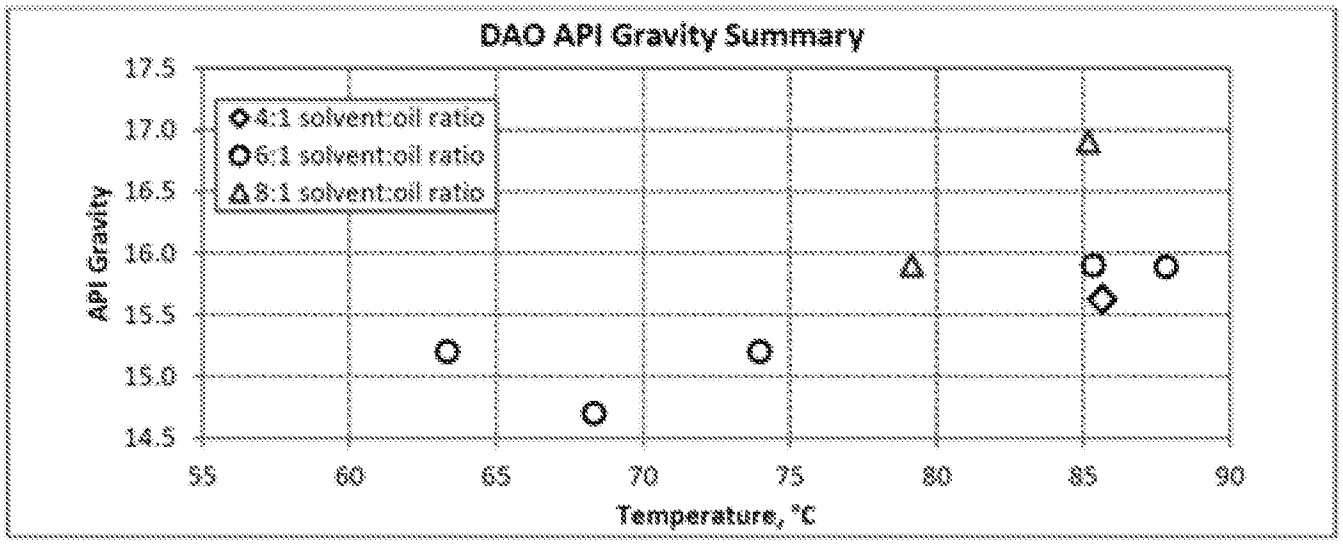
FIG. 11 shows results from performing solvent deasphalting on a heavy coker gas oil from a fluidized coker.

FIGS. 10 and 11 show results from performing propane deasphalting at various conditions on the fluidized coker heavy coker gas oil shown in Table 1. FIG. 10 shows the yield of deasphalted oil at various solvent-to-feed ratios (ranging from 2:1 to 8:1) and deasphalting temperatures (58° C. to 88° C.) while FIG. 11 shows the API gravity of the resulting deasphalted oil at the various conditions. As shown in FIG. 10, the heavy coker gas oil produced by the fluidized coker at partial conversion conditions can be separated into deasphalted oil and rock within the range of typical solvent deasphalting conditions. FIG. 11 further shows that the API gravity of the resulting deasphalted oil fractions is in a typical range of API gravity for a deasphalted oil.

In contrast to the results shown in FIGS. 10 and 11, when propane deasphalting was performed under similar solvent-to-feed ratios and temperatures on the delayed coker heavy coker gas oil shown in Table 1, no separation occurred to form separate deasphalted oil and rock phases. Apparently due to the more severe conversion conditions in the delayed coker, to the degree that "asphalt type" components are present in the delayed coker heavy coker gas oil, the quantities of the "asphalt type" components were apparently small enough to remain soluble in the oil phase under the deasphalting conditions.

Lubricant Base Oil Production Examples

Figure 3:
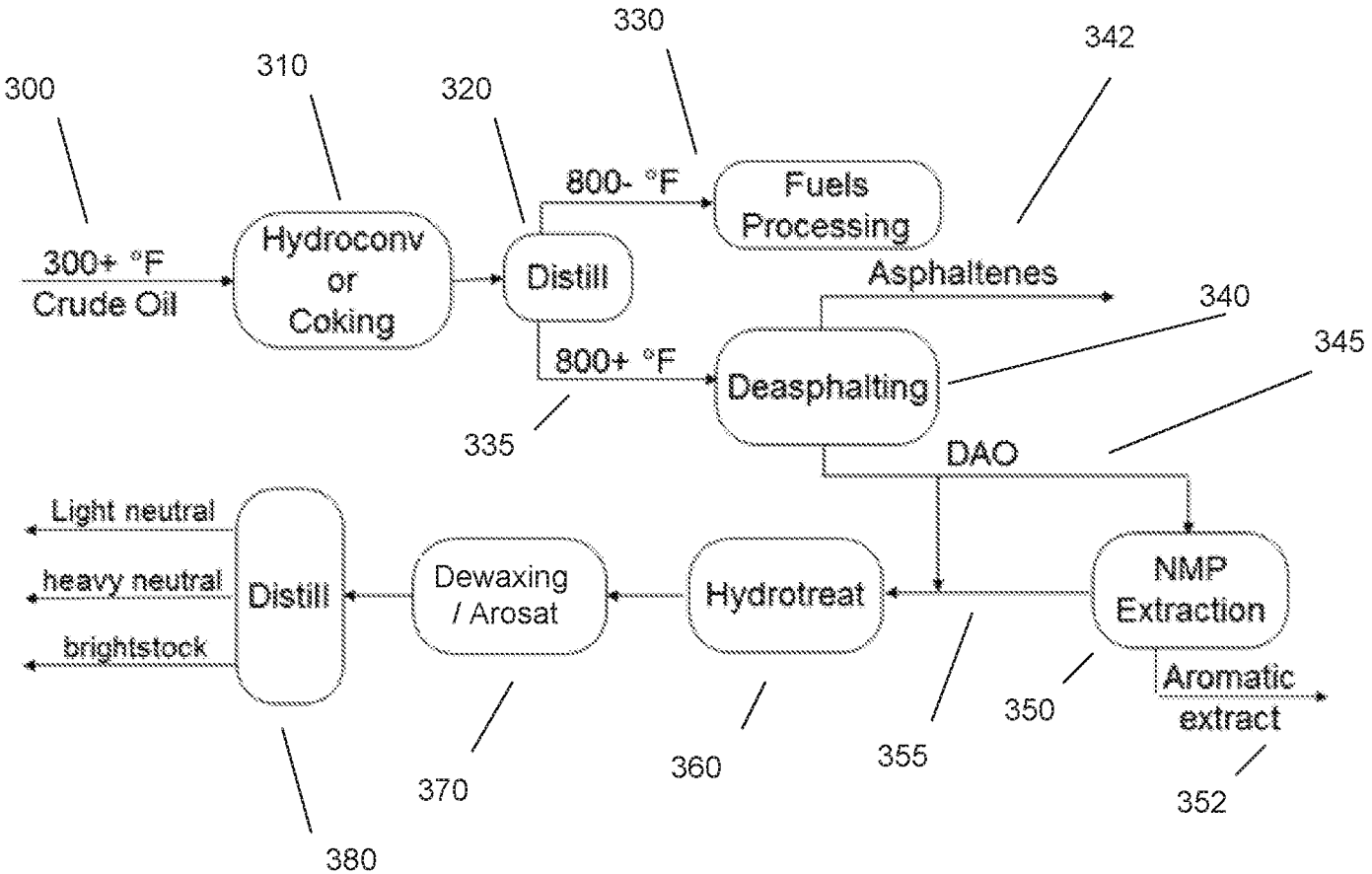
FIG. 3 shows an example of a processing flow for producing lubricant base oils.

FIG. 3 shows an example of a processing configuration for producing lubricant base oils from a thermally cracked resid fraction. As shown in FIG. 3, initially a feedstock 300, such as the 300° F.+ (149° C.) portion of a crude oil, is exposed to thermal cracking conditions 310 for a single pass conversion of 30 wt % to 80 wt % of the 1050° F.+ (566° C.) portion of the feedstock. The effluent from the thermal cracking process is then distilled 320 or otherwise separated based on boiling point to form at least a lower boiling portion, such as fuels portion 330, and a higher boiling portion 335. The distillation shown in FIG. 3 corresponds to a separation at a cut point of about 800° F. (427° C.), but other cut points suitable for forming a higher boiling portion corresponding to a gas oil fraction can be used, such as a cut point of at least about 650° F. (343° C.), or at least about 700° F. (370° C.), or at least about 750° F. (399° C.). The higher boiling portion 335 can then be deasphalted 340 to form a deasphalted oil 345 and an asphaltenes or rock portion 342. At least a portion of the deasphalted oil can optionally be solvent extracted 350, or the solvent extraction can be omitted. If solvent extraction is performed, an aromatic extract fraction 352 can be formed, along with a solvent extracted deasphalted oil 355 that has a reduced content of aromatics. The optionally solvent extracted deasphalted oil can then optionally be hydrotreated 360, followed by dewaxing and aromatic saturation 370. The dewaxed and aromatic saturated effluent can then be fractionated 380 to form one or more base oil fractions. If dewaxing 370 corresponds to a catalytic dewaxing process, the resulting base oils can be Group II or Group III base oils. If dewaxing 370 corresponds to a solvent dewaxing process, the resulting base oils can be Group I base oils.

Figure 4:
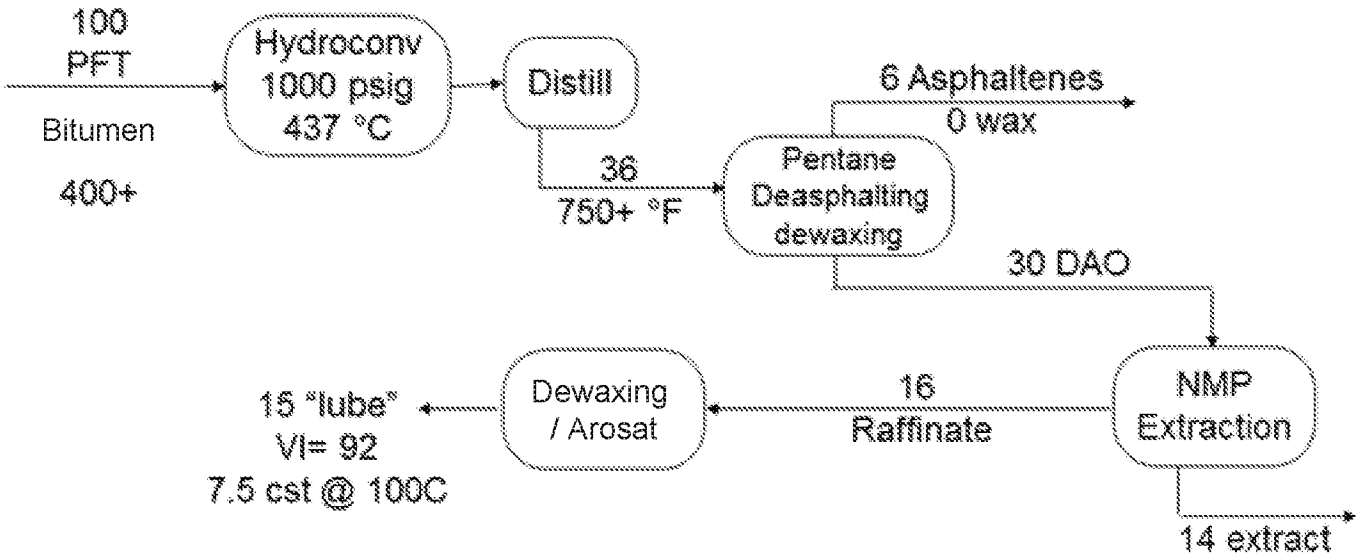
FIG. 4 shows an example of a processing flow that was used for processing a paraffinic froth treated bitumen.

In FIG. 4, a process flow following the general principles of FIG. 3 was used to process a crude fraction corresponding to a paraffin froth treated bitumen. The process conditions used for the various steps and the yields from each step are shown in FIG. 4. As shown in FIG. 4, the 400° F.+ (204° C.) portion of the paraffin froth treated bitumen was hydroconverted at 1000 psig of hydrogen at 437° C. Although this is a hydroconversion process, the high temperature and low hydrogen partial pressure result in a substantial amount of thermal cracking. After distillation to separate out the 750° F.+ (399° C.) portion of the hydroconversion effluent, the effluent was deasphalted and then solvent extracted. The raffinate from solvent extraction was then catalytically dewaxed and hydrofinished for aromatic saturation. The dewaxed, hydrofinished effluent provided a 15 wt % yield of a Group II heavy neutral basestock (7.5 cSt @100° C.) with a VI of 92. It is noted that further fractionation of the product, such as fractionation as shown in FIG. 3, can be performed to produce a full slate of basestock viscosity grades. If such a fractionation is performed, basestock viscosity grades from about 4 cSt to about 30 cSt can be produced.

Figure 5:
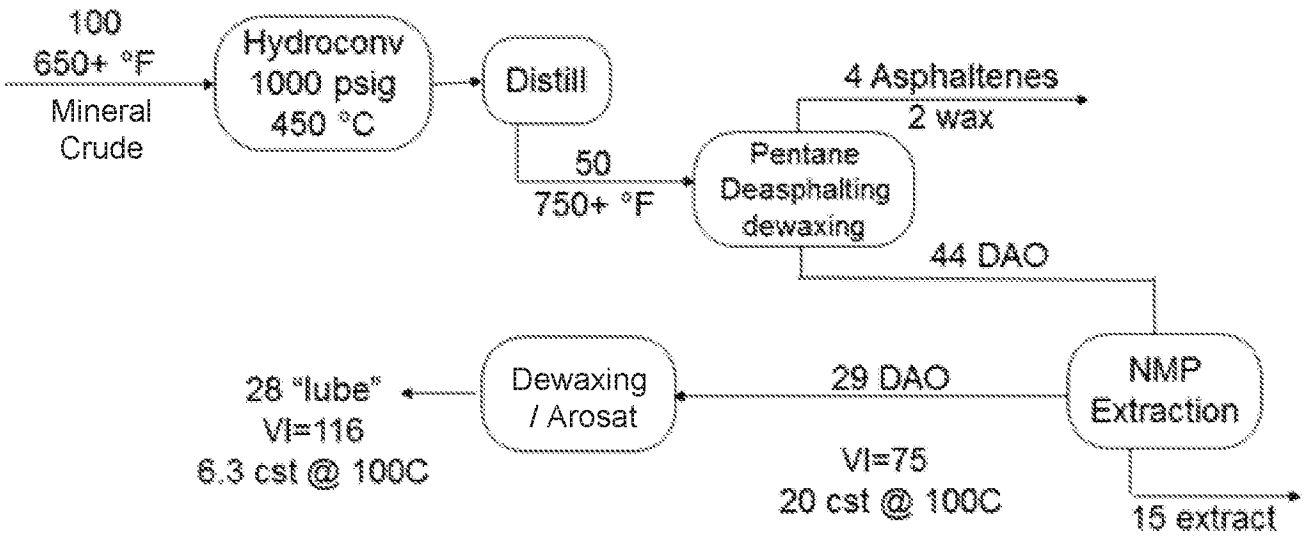
FIG. 5 shows an example of a processing flow that was used for processing a conventional mineral crude fraction.

FIG. 5 shows a similar process flow to FIG. 4, with the exception that the 650° F.+ (343° C.+) fraction of a conventional mineral crude was used as the initial feed. The resulting yield of heavy neutral lubricant base oil (6.3 cSt @100° C.) on the 650° F.+ fraction of the feed was 28 wt %. It is noted that performing aromatic saturation and/or hydrofinishing on the deasphalted oil for the resid from the conventional crude resulted in a surprisingly high increase in viscosity index of greater than 40 VI to produce a base oil with a VI of 116. It is noted that further fractionation of the product, such as fractionation as shown in FIG. 3, can be performed to produce a full slate of basestock viscosity grades. If such a fractionation is performed, basestock viscosity grades from about 4 cSt to about 30 cSt can be produced.

Figure 6:
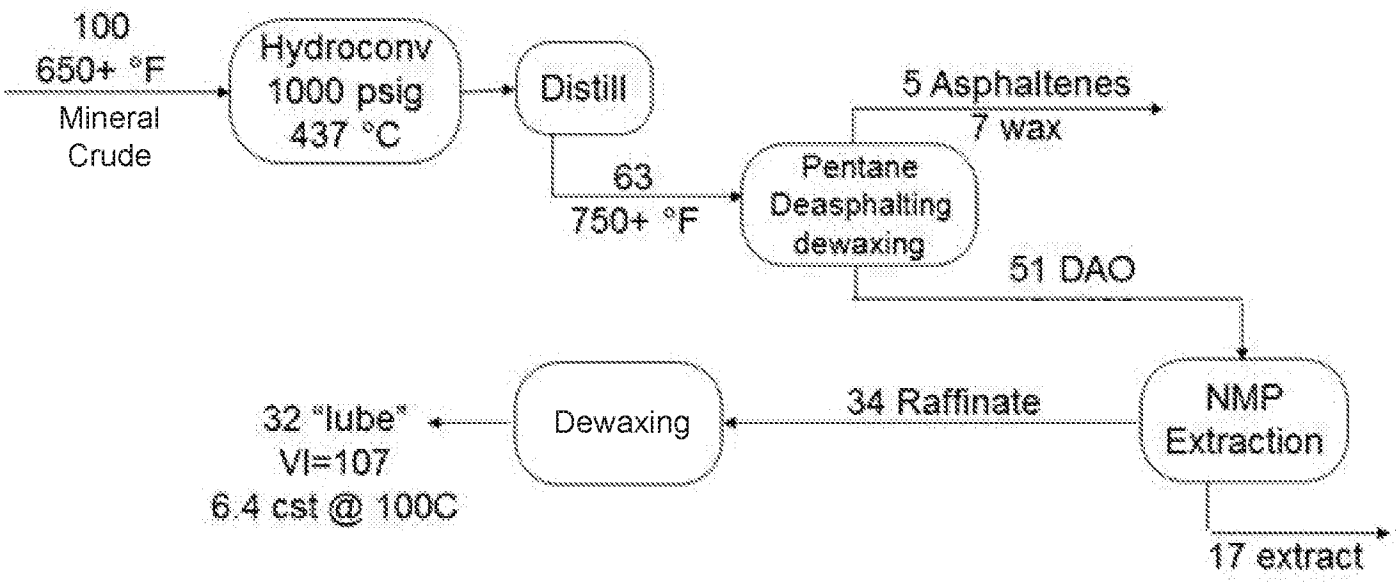
FIG. 6 shows an example of a processing flow that was used for processing a conventional mineral crude fraction.

FIG. 6 shows another example of performing a thermal cracking process (via hydroconversion) on the 650° F.+ (343° C.) fraction of a conventional crude oil from a different crude source than the crude in FIG. 5. FIG. 6 shows that a similar heavy neutral base oil (6.4 cSt @ 100° C.) was produced in a good yield (32 wt %), although the VI was slightly lower (107). This demonstrates that the process scheme of performing thermal cracking on the resid portion for forming lubricant base oils is applicable to a variety of crude oil sources. It is noted that further fractionation of the product, such as fractionation as shown in FIG. 3, can be performed to produce a full slate of basestock viscosity grades. If such a fractionation is performed, basestock viscosity grades from about 4 cSt to about 30 cSt can be produced.

Figure 7:
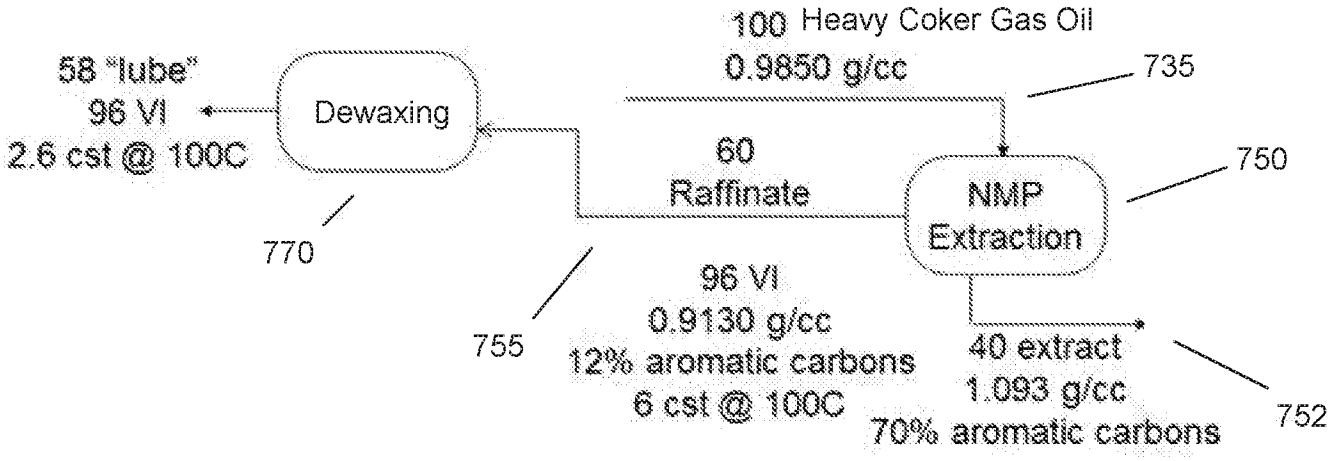
FIG. 7 shows an example of a processing flow for processing a feedstock that was thermally cracked in a delayed coker.

FIG. 7 shows another embodiment of inventive process scheme. In FIG. 7, a delayed coker was used as the process for thermal cracking. Because a delayed coker was used, the coking process was run at >90% single pass conversion of the 1050° F.+ (566° C.) fraction. In FIG. 7, the process started with using the gas oil fraction 735 from the coker as the feed. The heavy gasoil fraction 735 had a T90 boiling point of 1016° F. and a viscosity at 100° C. of 8.6 cSt. In the laboratory example, the delayed coker gas oil was not deasphalted as shown in FIG. 3, because it was from a delayed coker and did not contain asphaltenes. Based on the inability to separate similar delayed coker gasoils using solvent deasphalting, it was believed that this delayed coker gasoil also cannot be separated into DAO and rock. Instead, an NMP solvent extraction 750 was performed to generate an aromatics extract fraction 752 and a raffinate 755. The raffinate had a T90 boiling point of 950° F. (510° C.), a viscosity at 100° C. of 6.0 cSt, and a viscosity index of 96. The low viscosity and T90 boiling point of the raffinate indicated that it is not possible to obtain economically useful yields of heavy neutral or brightstock viscosity grades from this sample. The high viscosity index was a surprise as it proved that useful yields of light neutral lube basestock can be obtained from coker gasoil. Conventionally it is believed that, in addition to being low viscosity, coker gasoil raffinates are low in viscosity index when extracted to useful raffinate yields of >30%. The raffinate was then catalytically dewaxed and hydrofinished 770 to form a lubricant base oil. In contrast to the method using hydroconversion, in the process based on the configuration in FIG. 7, dewaxing/hydrofinishing 770 of the raffinate did not result in an increase in viscosity index. Instead, as expected from coker gasoil, it resulted in a substantial reduction in the viscosity and, at 2.6 centistokes, the final product was not sufficiently viscous to be used as a lube basestock (<4 censtistokes). It is noted that further fractionation of the product, such as fractionation as shown in FIG. 3, is required to remove the light ends to increase the viscosity in order to produce lubes.

Figure 9:
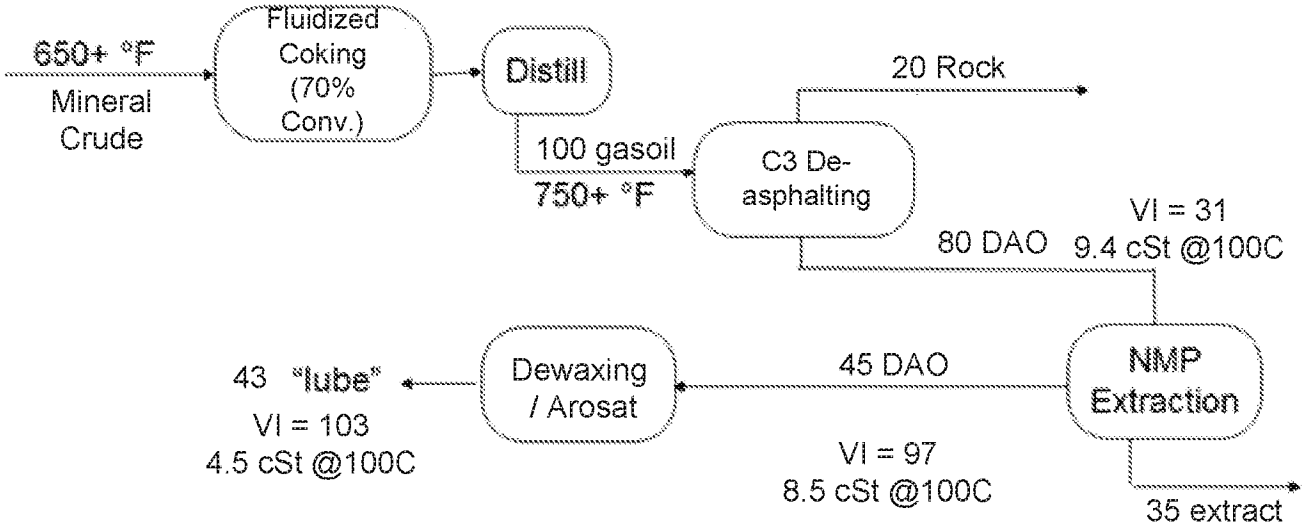
FIG. 9 shows an example of a processing flow for forming lubricant base oils from a feedstock that was thermally cracked in a fluidized coker.

FIG. 9 shows another embodiment of inventive process scheme. In FIG. 9, a flexicoker coker was used as the process for thermal cracking. Because a flexicoker was used, the coking process was run at 70% single pass conversion of the 1050° F.+ (566° C.) fraction. In FIG. 9, the process started with using the gas oil fraction from the flexicoker as the feed. The heavy gasoil fraction had a T90 boiling point of 1024° F. (551° C.) and a viscosity at 100° C. of 12.9 cSt. The coker gasoil was propane deasphalted into 20 wt % rock and 80 wt % DAO. The DAO had a T90 boiling point of 996° F. (536° C.) and a viscosity at 100° C. of 9.4 cSt, and a viscosity index of 31. The DAO is extracted with NMP into 55 wt % raffinate and 45 wt % extract. The raffinate had a T90 boiling point of 995° F. (535° C.), a viscosity at 100° C. of 8.5 cst, and a viscosity index of 97. The high viscosity and T90 boiling point of the raffinate indicated that it is, surprisingly, possible to obtain economically useful yields of HN or brightstock viscosity grades from this sample. The high viscosity index was unexpected as it proved that useful yields of the full viscosity range of lube basestock can be obtained from flexicoker gasoil. Conventionally it is believed that, in addition to being low viscosity, coker gasoil raffinates are low in viscosity index when extracted to useful raffinate yields of >30%.

Optionally, the raffinate from the configuration in FIG. 9 could then be catalytically dewaxed and hydrofinished to form a lubricant base oil. Similar to the method using hydroconversion, but in contrast to the method using delayed coker gas oil in FIG. 7, in the process based on the configuration in FIG. 9, dewaxing/hydrofinishing of the raffinate is believed to result in an increase in viscosity index from 97 to 103. The viscosity at 100° C. was reduced to 4.5 centistokes, and, unlike the delayed coker sample, was sufficiently viscous to be used as a lube basestock without further distillation (>4 centistokes). Alternatively, if a fractionation is performed, basestock viscosity grades from about 4 cSt to about 30 cSt at 100° C. can be produced.

Figure 8:
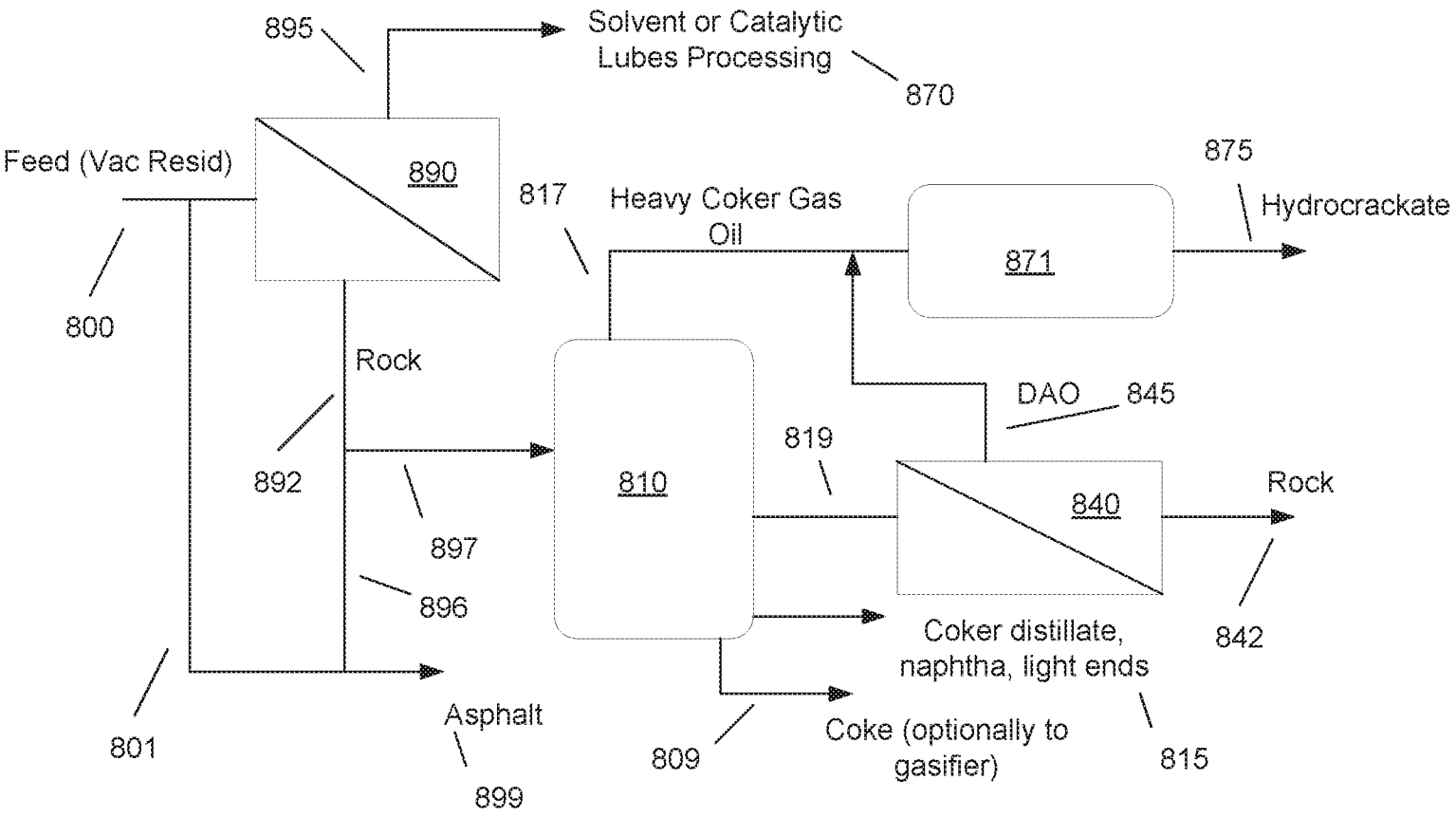
FIG. 8 shows an example of a processing flow for producing lubricant base oils.

FIG. 8 shows another example of configuration for producing lubricant base oils from an integrated process involving a coker. In FIG. 8, a vacuum resid feed 800 is first deasphalted 890, such as by propane deasphalting. This produces a deasphalted oil 895 suitable for further processing to form lubricant base oils either by solvent or catalytic processing 870. This also produces rock 892. A portion 896 of the rock can be combined with additional vacuum resid feed 801 to form asphalt 899. A remaining portion 897 of the rock can be passed into a fluidized coker or another type of coker 810 that can operate with about 50% to about 80% conversion in a single pass relative to a conversion temperature of about 1050° F. (565° C.). The coker 810 can produce a variety of products. Typical coker products can include coke 809 (optionally gasified to produce coker fuel gas) as well as various light ends, naphtha, and distillate boiling range streams 815. The coker 810 can also produce a heavy coker gas oil 817 that can be suitable for introduction into lubes hydrocracking process 871 for forming hydrocrackate 875. Additionally, the coker 810 can produce a still heavier gas oil fraction 819 that is passed to a deasphalting unit 840. The deasphalted oil 845 from deasphalting unit 840 can be added to the feed for lubes hydrocracking process 871. The deasphalting unit 840 can also generate a rock product 842.

Figure 12:
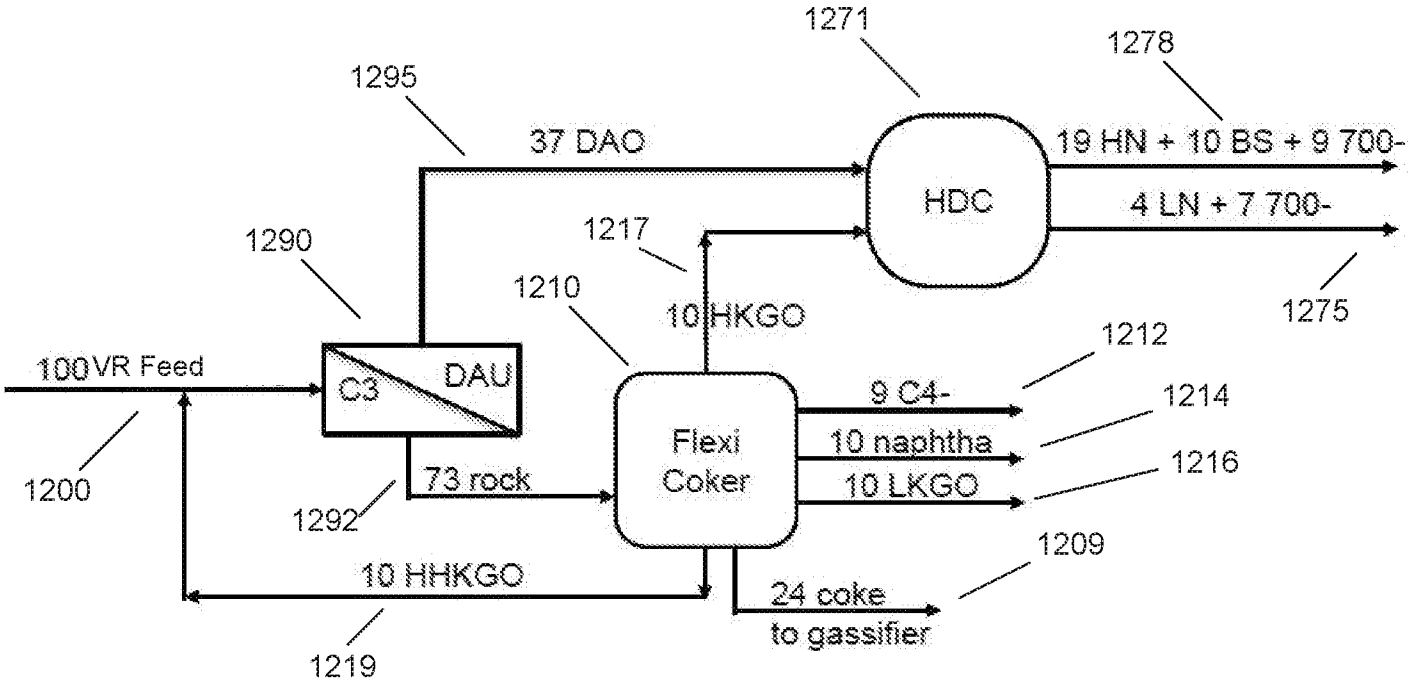
FIG. 12 shows another example of a process flow for producing lubricant base oils.

FIG. 12 shows a variation on the type of process shown in FIG. 8. In FIG. 12, a vacuum resid feed 1200 (or other suitable feed) is first deasphalted 1290, such as by propane deasphalting. This produces a deasphalted oil 1295. This also produces rock 1292. The rock 1292 can be passed into a fluidized coker or another type of coker 1210 that can operate with about 50% to about 80% conversion in a single pass relative to a conversion temperature of about 1050° F. (565° C.). The coker 1210 can produce a variety of products. Typical coker products can include coke 1209 (optionally gasified to produce coker fuel gas) as well as light ends stream(s) 1212, naphtha stream(s) 1214, and distillate boiling range stream(s) 1216. The coker 1210 can also produce a heavy coker gas oil 1217 that can be suitable for introduction into one or more lubes hydrocracking processes 1271 along with deasphalted oil 1295. The hydrocracking process train can also include dewaxing and/or hydrofinishing (not shown) to allow for production of lubricant base stocks. In the example shown in FIG. 12, two separate catalytic processing trains are used to produce a heavier and/or brightstock set of base stock products 1278 and a lighter set of base stock products 1275. The products 1275 and 1278 from the separate processing trains can also include a fuels boiling range (371° C.−) portion. Additionally, the coker 1210 can produce a still heavier gas oil fraction 1219 that is combined with feed 1200 for introduction into deasphalting unit 1290. The configuration shown in FIG. 12 can allow for conversion of vacuum resid into lubricant base oil products while using only one (propane) deasphalting process.

FIG. 12 also shows a rough volume balance for a representative process that was performed using the configuration in FIG. 12. In the volume balance shown in FIG. 12, 100 volume units of an initial vacuum resid feed (or other feed with a suitable boiling range) are introduced into the deasphalting unit. 10 volume units of a high boiling portion (T10 of at least 427° C., or at least 454° C., or at least 482° C.) of a heavy coker gas oil were also recycled for use as part of the feed to the deasphalting unit. The deasphalting unit generated 37 volume units of deasphalted oil and 73 volume units of rock (i.e., deasphalting unit residue). The rock was coked under conditions suitable for one-pass conversion of 50 wt % to 80 wt % of the 566° C.+ portion of the rock, such as using flexi-coking or fluidized coking, to form 24 volume units of coke, 29 volume units of light ends and fuel boiling range products, 10 units of a lower boiling portion of a heavy coker gas oil, and the 10 units of the higher boiling portion of heavy coker gas oil that was recycled for use as part of the feed. The lower boiling portion of the heavy coker gas oil and the deasphalted oil were further processed to form lubricant base oil fractions, resulting in 19 volume units of heavy neutral lubricant base stock, 10 volume units of bright stock, 4 volume units of light neutral lubricant base stock, and 16 volume units of fuels and light ends.

Additional Embodiments

Embodiment 1. A method for producing a lubricant base oil product, comprising: providing a feedstock comprising a 650° F.+ (343° C.) fraction, at least about 10 wt % of the 650° F.+ fraction comprising a portion having a boiling point of at least about 1050° F. (566° C.); exposing at least a portion of the 650° F.+ (343° C.) fraction to effective thermal cracking conditions to form a thermal cracking effluent, the thermal cracking effluent comprising at least a first thermal cracking effluent fraction having a 10% distillation point of at least about 700° F. (371° C.) and a second thermal cracking effluent fraction having a lower boiling range, the effective thermal cracking conditions being selected for single pass conversion of about 30 wt % to about 80 wt % of the portion having a boiling point of at least about 1050° F. (566° C.); and deasphalting at least a portion of the first thermal cracking effluent to form at least a deasphalted thermal cracking effluent and a deasphalting residual product; wherein at least a first portion of the deasphalted thermal cracking effluent has a viscosity index of at least about 50 and a viscosity at 100° C. of at least about 7.0 cSt.

Embodiment 2. The method of Embodiment 1, the method further comprising: exposing the at least a first portion of the deasphalted thermal cracking effluent to a dewaxing catalyst under effective catalytic dewaxing conditions and a hydrofinishing catalyst under effective hydrofinishing conditions, to form a dewaxed, hydrofinished effluent, wherein the dewaxed, hydrofinished effluent has a viscosity index that is at least about 5 greater than the viscosity index of the at least a portion of the deasphalted thermal cracking effluent, or at least about 10 greater, or at least about 15 greater, or at least about greater.

Embodiment 3. The method of Embodiments 1 or 2, wherein the at least a first portion of the deasphalted thermal cracking effluent having a viscosity index of at least about 50 and a viscosity of at least about 7.0 cSt at 100° C. comprises a raffinate from performing a solvent extraction on at least a second portion of the deasphalted thermal cracking effluent, a raffinate yield from performing the solvent extraction on the at least a second portion of the deasphalted thermal cracking effluent optionally being at least about 25 wt %, or at least about 30 wt %, or at least about 40 wt %, or at least about 50 wt %.

Embodiment 4. The method of Embodiments 1 or 2, further comprising hydrocracking at least a second portion of the deasphalted thermal cracking effluent under effective hydrocracking conditions to form a hydrocracked deasphalted thermal cracking effluent having a sulfur content of about 300 wppm or less, the at least a first portion of the deasphalted thermal cracking effluent comprising at least a portion of the hydrocracked deasphalted thermal cracking effluent, wherein exposing the deasphalted thermal cracking effluent to the dewaxing catalyst and the hydrofinishing catalyst comprises exposing the hydrocracked deasphalted thermal cracking effluent to the dewaxing catalyst and the hydrofinishing catalyst.

Embodiment 5. The method of any of the above embodiments, further comprising hydrotreating the at least a first portion of the deasphalted thermal cracking effluent under effective hydrotreating conditions to form a hydrotreated deasphalted thermal cracking effluent having a sulfur content of about 300 wppm or less, wherein exposing the at least a first portion of the deasphalted thermal cracking effluent to the dewaxing catalyst and the hydrofinishing catalyst comprises exposing the hydrotreated deasphalted thermal cracking effluent to the dewaxing catalyst and the hydrofinishing catalyst.

Embodiment 6. The method of any of the above embodiments, wherein at least 50 wt % of the 650° F.+ (343° C.) fraction has a boiling point of at least about 1050° F. (566° C.), wherein the first thermal cracking effluent has a T95 boiling point of at least about 1050° F. (566° C.), or a combination thereof.

Embodiment 7. The method of any of the above embodiments, wherein the at least a first portion of the deasphalted thermal cracking effluent has a viscosity index of at least about 60, or at least about 70, at least about 75, or at least about 80, or at least about 85, or at least about 90, or wherein the at least a first portion of the deasphalted thermal cracking effluent has a viscosity at 100° C. of at least about 7.5 cSt, or at least about 8.0 cSt, or at least about 8.5 cSt, or a combination thereof.

Embodiment 8. A method for producing a lubricant base oil product, comprising: providing a feedstock comprising a 650° F.+ (343° C.) fraction, at least about 10 wt % of the 650° F.+ fraction comprising a portion having a boiling point of at least about 1050° F. (566° C.); deasphalting a first portion of the feedstock to form at least a first deasphalted oil and a first deasphalting residual product; exposing at least a first portion of first deasphalting residual product to effective thermal cracking conditions to form a thermal cracking effluent, the thermal cracking effluent comprising at least a first thermal cracking effluent fraction having a 10% distillation point of at least about 650° F. (343° C.) (or at least about 700° F. (371° C.)) and a second thermal cracking effluent fraction having a lower boiling range, the effective thermal cracking conditions being selected for single pass conversion of about 50 wt % to about 80 wt % of the portion having a boiling point of at least about 1050° F. (566° C.); deasphalting at least a portion of the first thermal cracking effluent portion to form at least a deasphalted thermal cracking effluent, the deasphalted thermal cracking effluent having a first viscosity index; exposing at least a portion of the deasphalted thermal cracking effluent to a hydrocracking catalyst under effective hydrocracking conditions to form a hydrocracked effluent; and exposing at least a portion of the hydrocracked effluent to a dewaxing catalyst under effective catalytic dewaxing conditions, and a hydrofinishing catalyst under effective hydrofinishing conditions, to form one or more lubricant products, the one or more lubricant products having a viscosity of at least about 6 cSt at 100° C. and a viscosity index of at least about 90, a yield of the one or more lubricant products being at least about 15 wt % of the 650° F.+ (343° C.) fraction of the feedstock.

Embodiment 9. The method of Embodiment 8, wherein deasphalting a feedstock comprising a 650° F.+ (343° C.) fraction comprises deasphalting a feedstock comprising the 650° F.+ fraction and a recycled fraction, wherein exposing at least a portion of the deasphalting residual product to effective thermal cracking conditions further comprises forming a third thermal cracking effluent having a 10% distillation point of at least 800° F., wherein the method further comprises recycling at least a portion of the third thermal cracking effluent as the recycled fraction, and wherein exposing at least a portion of the deasphalted thermal cracking effluent to a hydrocracking catalyst comprises exposing at least a portion of the deasphalted thermal cracking effluent and at least a portion of the first deasphalted oil.

Embodiment 10. The method of Embodiment 8 or 9, wherein deasphalting at least a portion of the first thermal cracking effluent fraction comprises deasphalting at least a portion of the first thermal cracking effluent fraction and at least a portion of the second thermal cracking effluent fraction.

Embodiment 11. The method of any of Embodiments 8 to 10, further comprising combining a second portion of the feedstock and a second portion of the first deasphalting residual product to form an asphalt feed.

Embodiment 12. The method of any of Embodiments 8 to 11, further comprising forming a Group I base oil from the first deasphalted oil, the forming a Group I base oil comprising solvent extracting at least a portion of the first desaphalted oil to form an extraction raffinate; and solvent dewaxing at least a portion of the extraction raffinate to form a Group I base oil.

Embodiment 13. The method of any of Embodiments 8 to 12, further comprising forming a base oil from the first deasphalted oil, the forming a base oil comprising: hydrocracking at least a portion of the first deasphalted oil in the presence of a hydrocracking catalyst to form a hydrocracked effluent; dewaxing at least a portion of the hydrocracked effluent in the presence of a dewaxing catalyst and hydrofinishing at least a portion of the hydrocracked effluent in the presence of a hydrofinishing catalyst to form a base oil.

Embodiment 14. The method of any of the above embodiments, further comprising distilling the feedstock comprising the 650° F.+ (343° C.) fraction to form the at least a portion of the 650° F.+ fraction.

Embodiment 15. The method of any of the above embodiments, wherein the effective thermal cracking conditions comprise hydroconversion conditions, the hydroconversion conditions including a temperature of at least about 400° C. and a hydrogen partial pressure of about 1500 psig (10.3 MPa) or less.

Embodiment 16. The method of any of the above embodiments, wherein the effective thermal cracking conditions comprise fluidized coking conditions, including a temperature of at least 500° C. and a pressure of 50 psig (345 kPa) or less.

Embodiment 17. The method of any of the above embodiments, wherein the effective thermal cracking conditions comprise fluidized coking conditions or visbreaking conditions.

Embodiment 18. A method for producing a lubricant base oil product, comprising: providing a feedstock comprising a 650° F.+ (343° C.) fraction, at least about 10 wt % of the 650° F.+ fraction comprising a portion having a boiling point of at least about 1050° F. (565° C.); exposing at least a portion of the 650° F.+ fraction to effective thermal cracking conditions to form a thermal cracking effluent, the thermal cracking effluent comprising at least a first thermal cracking effluent fraction having a 10% distillation point of at least about 700° F. (370° C.) and a second thermal cracking effluent fraction having a lower boiling range, the effective thermal cracking conditions being selected for conversion of about 30 wt % to about 80 wt % of the portion having a boiling point of at least about 1050° F. (565° C.); deasphalting at least a portion of the first thermal cracking effluent fraction to form at least a deasphalted thermal cracking effluent; dewaxing at least a portion of the deasphalted thermal cracking effluent under effective solvent dewaxing conditions to form at least one lubricant base oil product; and exposing at least a portion of the at least one lubricant base oil product to a hydrofinishing catalyst under effective hydrofinishing conditions, wherein the at least a portion of the deasphalted thermal cracking effluent has a first viscosity index when exposed to the hydrofinishing catalyst, the dewaxed, hydrofinished effluent having a viscosity index that is at least about 5 greater than the first viscosity index.

Embodiment 19. A lubricant base oil composition formed according to the method of any of the above embodiments.

Embodiment 20. A naphthenic base oil composition comprising at least 40 wt % naphthenes and having a viscosity index of at least 120, the naphthenic base oil optionally having a viscosity at 100° C. of at least 10 cSt, or at least 15 cSt, or at least 20 cSt.

Embodiment 21. A naphthenic base oil composition comprising at least 20 wt % 3+ ring naphthenes having a viscosity of at least 15 cSt at 100° C. and a viscosity index of at least 80, or at least 90, or at least 100, the viscosity index optionally being 120 or less, the naphthenic base oil optionally further comprising at least 30 wt % naphthenes, or at least 40 wt % naphthenes.

Embodiment 22. A thermally cracked gas oil composition comprising at least 15 wt % olefins (or at least 20 wt % olefins), the thermally cracked gas oil composition having a 10 wt % distillation point of at least 343° C., 2.0 wt %-5.0 wt % (or at least 2.5 wt %) of micro-carbon residue, and an API gravity of 15 or less, at least 15 wt % (or at least 20 wt %) of the thermally cracked gas oil composition having boiling point of greater than 510° C., the thermally cracked gas oil composition optionally having a kinematic viscosity at 100° C. of at least 8 cSt.

Embodiment 23. A deasphalted oil formed from propane deasphalting of a thermally cracked gas oil composition, the thermally cracked gas oil composition having a 10 wt % distillation point of at least 343° C., 2.0 wt %-5.0 wt % (or at least 2.5 wt %) of micro-carbon residue, and an API gravity of 15 or less, at least 15 wt % (or at least 20 wt %) of the thermally cracked gas oil composition having boiling point of greater than 510° C., the thermally cracked gas oil composition optionally having a kinematic viscosity at 100° C. of at least 8 cSt, the thermally cracked gas oil composition optionally comprising at least 15 wt % olefins (or at least 20 wt % olefins).

Embodiment 24. The thermally cracked gas oil composition of Embodiment 22 or the deasphalted oil of Embodiment 23, wherein the thermally cracked gas oil composition comprises at least 0.03 wt % of n-heptane insolubles, 0.1 wt % to 2.0 wt % (or at least 0.2 wt %) of pentane insolubles, or a combination thereof.

Embodiment 25. The thermally cracked gas oil composition of Embodiment 22 or 24, or the deasphalted oil of Embodiment 23 or 24, wherein the thermally cracked gas oil composition is formed by the method comprising: providing a feedstock comprising a 343° C.+ fraction, at least 10 wt % of the 343° C.+ fraction comprising a portion having a boiling point of at least 566° C.; exposing at least a portion of the 343° C.+ fraction to effective thermal cracking conditions to form a thermal cracking effluent, the thermal cracking effluent comprising at least the thermally cracked gas oil composition and a second thermal cracking effluent fraction having a lower boiling range, the effective thermal cracking conditions being selected for conversion of 30 wt % to 80 wt % of the portion having a boiling point of at least 1050° F.

Embodiment 26. A lubricant base oil composition having a sulfur content of less than 0.03 wt %, an aromatics content of less than 10 wt %, a viscosity index of at least 80, a viscosity at 100° C. of at least 6 cSt, the lubricant base oil composition being formed by catalytic dewaxing and hydrofinishing of a deasphalted thermally cracked gas oil, the deasphalted thermally cracked gas oil optionally corresponding to the deasphalted oil of any of Embodiments 23-25.

When numerical lower limits and numerical upper limits are listed herein, ranges from any lower limit to any upper limit are contemplated. While the illustrative embodiments of the disclosure have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains.

The present disclosure has been described above with reference to numerous embodiments and specific examples. Many variations will suggest themselves to those skilled in this art in light of the above detailed description. All such obvious variations are within the full intended scope of the appended claims.

What is claimed is:

1. A naphthenic base oil composition comprising: at least 40 wt % naphthenes, the naphthenic base oil having a viscosity index of at least 120, the naphthenic base oil having a viscosity at 100° C. of at least 10 cSt.

2. The naphthenic base oil composition of claim 1, wherein the naphthenic base oil composition comprises at least 90 wt% saturated molecules.

3. The naphthenic base oil composition of claim 2, wherein the naphthenic base oil composition comprises less than 0.03 wt % sulfur.

4. The naphthenic base oil composition of claim 2, wherein the naphthenic base oil composition has a pour point of −15° C. or less.

5. The naphthenic base oil composition of claim 2, wherein the naphthenic base oil composition has a pour point of −18° C. or less.

6. The naphthenic base oil composition of claim 2, wherein the naphthenic base oil composition has a pour point of −20° C. or less.

7. The naphthenic base oil composition of claim 2, wherein the naphthenic base oil composition has a viscosity index of about 120 to about 160.

8. The naphthenic base oil composition of claim 7, wherein the naphthenic base oil composition has a viscosity index of about 140 to about 160.

9. The naphthenic base oil composition of claim 2, wherein the naphthenic base oil has a viscosity at 100° C. of about 15 cSt to about 50 cSt.

10. The naphthenic base oil composition of claim 9, wherein the naphthenic base oil has a viscosity at 100° C. of about 20 cSt to about 50 cSt.

11. The naphthenic base oil composition of claim 2, wherein the naphthenic base oil has at least 25 wt % 3+ ring naphthenes.

12. The naphthenic base oil composition of claim 11, wherein the naphthenic base oil has at least 35 wt % 3+ ring naphthenes.

13. The naphthenic base oil composition of claim 12, wherein the naphthenic base oil has at least 40 wt % 3+ ring naphthenes.

14. The naphthenic base oil composition of claim 2, wherein the naphthenic base oil has a T5 boiling point of at least 370° C.

15. The naphthenic base oil composition of claim 2, wherein the naphthenes are 2-4 ring naphthenes having linear sidechains.

16. A naphthenic base oil composition comprising:

at least 20 wt % 3+ ring naphthenes, the naphthenic base oil having a viscosity of at least 15 cSt at 100° C. and a viscosity index of about 80 to about 120.

17. The naphthenic base oil of claim 16, wherein the naphthenic base oil has at least 35 wt % 3+ ring naphthenes.

18. The naphthenic base oil composition of claim 17, wherein the naphthenic base oil has at least 40 wt % 3+ ring naphthenes.

19. The naphthenic base oil composition of claim 16, wherein the naphthenic base oil has a viscosity at 100° C. of about 20 cSt to about 50 cSt.

20. The naphthenic base oil composition of claim 16, wherein the naphthenes have linear sidechains.

* * * * *